US008613524B2

(12) United States Patent
Sekela et al.

(10) Patent No.: US 8,613,524 B2
(45) **Date of Patent: *Dec. 24, 2013**

(54) REFRACTIVE OPTICS TO PROVIDE UNIFORM ILLUMINATION IN A DISPLAY CASE

(75) Inventors: William Sekela, Aurora, OH (US); Mathew Sommers, Sagamore Hills, OH (US); Larry Stadelman, Stow, OH (US); Mark Kaminski, Tucson, AZ (US); Samantha Schultz, Valley View, OH (US)

(73) Assignee: GE Lighting Solutions, LLC, Cleveland, OH (US)

( * ) Notice: Subject to any disclaimer, the term of this patent is extended or adjusted under 35 U.S.C. 154(b) by 281 days.

This patent is subject to a terminal disclaimer.

(21) Appl. No.: 12/913,255

(22) Filed: Oct. 27, 2010

(65) Prior Publication Data

US 2011/0096533 A1 Apr. 28, 2011

Related U.S. Application Data

(60) Provisional application No. 61/255,287, filed on Oct. 27, 2009.

(51) Int. Cl.

| | |
|---|---|
| ***A47F 11/10*** | (2006.01) |
| ***F21S 4/00*** | (2006.01) |
| ***F21V 5/00*** | (2006.01) |
| ***F21V 15/015*** | (2006.01) |

(52) U.S. Cl.
USPC ..... 362/125; 362/219; 362/244; 362/249.02

(58) Field of Classification Search
USPC ..... 362/125, 245, 219, 244, 249.02; 40/544, 559, 560
See application file for complete search history.

(56) References Cited

U.S. PATENT DOCUMENTS

| | | | | |
|---|---|---|---|---|
| 5,810,468 | A * | 9/1998 | Shimada | 362/146 |
| 6,076,950 | A * | 6/2000 | Topping et al. | 362/545 |
| 6,302,557 | B1 * | 10/2001 | Santosuosso et al. | 362/125 |
| 6,505,963 | B1 * | 1/2003 | Chiang | 362/545 |
| 6,566,824 | B2 * | 5/2003 | Panagotacos et al. | 315/291 |
| 6,598,999 | B2 * | 7/2003 | Horiuchi et al. | 362/335 |
| 6,793,369 | B2 * | 9/2004 | Calzaretta et al. | 362/219 |

(Continued)

FOREIGN PATENT DOCUMENTS

| | | |
|---|---|---|
| EP | 1 970 620 A1 | 9/2008 |
| WO | WO 2008/047335 | 4/2008 |

OTHER PUBLICATIONS

PCT Search Report from European Patent Office for PCT/US2010/054263.

*Primary Examiner* — Alan Cariaso
(74) *Attorney, Agent, or Firm* — Fay Sharpe LLP

(57) ABSTRACT

A lighting assembly for illuminating a display case, where the lighting assembly is mounted to a display case and includes a visibility envelop within which an onlooker of the display case cannot see. The lighting assembly includes an elongated frame provisioned to receive modular inserts and at least one modular insert operatively connected to the elongated frame. The at least one modular insert includes a light module, where the light module includes an optical lens and a light source. The optical lens is disposed over and/or around the light source and is disposed exclusively within the visibility envelope. The optical lens is fashioned to control light emitted from the light source using refraction and total internal reflection.

9 Claims, 12 Drawing Sheets

(56) References Cited

U.S. PATENT DOCUMENTS

| | | | | |
|---|---|---|---|---|
| 7,121,675 | B2 * | 10/2006 | Ter-Hovhannisian | 362/92 |
| 7,217,004 | B2 * | 5/2007 | Park et al. | 362/240 |
| 7,267,461 | B2 * | 9/2007 | Kan et al. | 362/373 |
| 7,273,300 | B2 * | 9/2007 | Mrakovich | 362/249.01 |
| 7,320,531 | B2 * | 1/2008 | West et al. | 362/231 |
| 7,513,637 | B2 * | 4/2009 | Kelly et al. | 362/126 |
| 7,766,509 | B1 * | 8/2010 | Laporte | 362/249.02 |
| 7,809,237 | B2 * | 10/2010 | Pozdnyakov et al. | 385/146 |
| 7,824,056 | B2 * | 11/2010 | Madireddi et al. | 362/125 |
| 7,857,482 | B2 * | 12/2010 | Reo et al. | 362/225 |
| 7,901,102 | B2 * | 3/2011 | Jung et al. | 362/97.3 |
| 8,057,061 | B2 * | 11/2011 | Otsuki et al. | 362/125 |
| 8,157,414 | B2 * | 4/2012 | Schaefer et al. | 362/245 |
| 2002/0114155 | A1 * | 8/2002 | Katogi et al. | 362/219 |
| 2003/0063463 | A1 * | 4/2003 | Sloan et al. | 362/238 |
| 2005/0190553 | A1 | 9/2005 | Lynch et al. | |
| 2007/0183637 | A1 | 8/2007 | Kreuzer et al. | |
| 2008/0298058 | A1 * | 12/2008 | Kan et al. | 362/240 |
| 2011/0096551 | A1 * | 4/2011 | Sekela et al. | 362/296.01 |

* cited by examiner

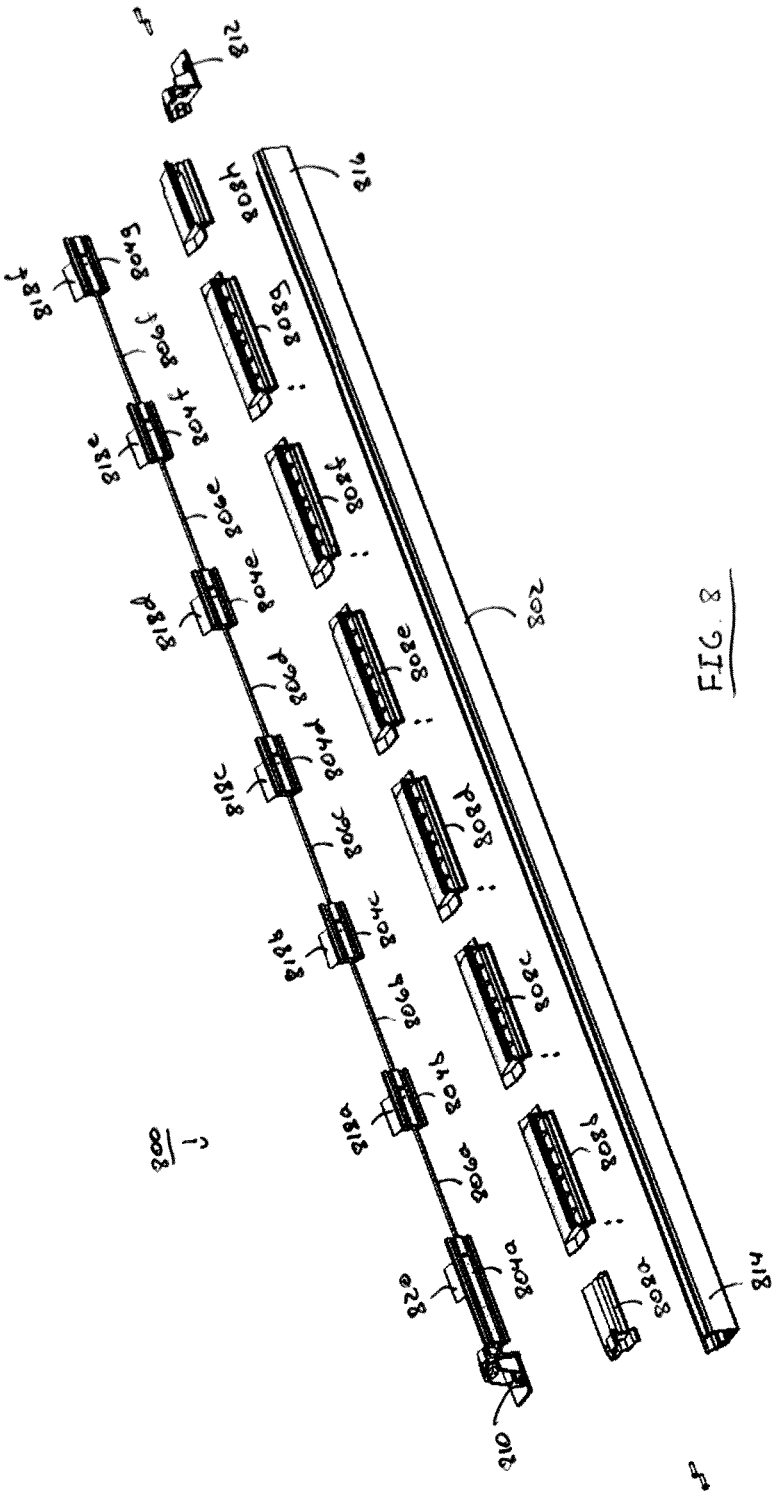
218
208
208a
208b
208c
208d
208e
208f
208g
208h
208i
208j
208k
208l
208m
208n
208o
208p
208q
208r
208s
208t
208u
208v
208w
208x
208y
208z
208aa
208ab
208ac
208ad
208ae
208af
208ag
208ah
208ai
208aj
208ak
208al
208am
208an
208ao
208ap
208aq
208ar
208as
208at
208au
208av
208aw
208ax
208ay
208az
208ba
208bb
208bc
208bd
208be
208bf
208bg
208bh
208bi
208bj
208bk
208bl
208bm
208bn
208bo
208bp
208bq
208br
208bs
208bt
208bu
208bv
208bw
208bx
208by
208bz
208ca
208cb
208cc
208cd
208ce
208cf
208cg
208ch
208ci
208cj
208ck
208cl
208cm
208cn
208co
208cp
208cq
208cr
208cs
208ct
208cu
208cv
208cw
208cx
208cy
208cz
208da
208db
208dc
208dd
208de
208df
208dg
208dh
208di
208dj
208dk
208dl
208dm
208dn
208do
208dp
208dq
208dr
208ds
208dt
208du
208dv
208dw
208dx
208dy
208dz
208ea
208eb
208ec
208ed
208ee
208ef
208eg
208eh
208ei
208ej
208ek
208el
208em
208en
208eo
208ep
208eq
208er
208es
208et
208eu
208ev
208ew
208ex
208ey
208ez
208fa
208fb
208fc
208fd
208fe
208ff
208fg
208fh
208fi
208fj
208fk
208fl
208fm
208fn
208fo
208fp
208fq
208fr
208fs
208ft
208fu
208fv
208fw
208fx
208fy
208fz
208ga
208gb
208gc
208gd
208ge
208gf
208gg
208gh
208gi
208gj
208gk
208gl
208gm
208gn
208go
208gp
208gq
208gr
208gs
208gt
208gu
208gv
208gw
208gx
208gy
208gz
208ha
208hb
208hc
208hd
208he
208hf
208hg
208hh
208hi
208hj
208hk
208hl
208hm
208hn
208ho
208hp
208hq
208hr
208hs
208ht
208hu
208hv
208hw
208hx
208hy
208hz
208ia
208ib
208ic
208id
208ie
208if
208ig
208ih
208ii
208ij
208ik
208il
208im
208in
208io
208ip
208iq
208ir
208is
208it
208iu
208iv
208iw
208ix
208iy
208iz
208ja
208jb
208jc
208jd
208je
208jf
208jg
208jh
208ji
208jj
208jk
208jl
208jm
208jn
208jo
208jp
208jq
208jr
208js
208jt
208ju
208jv
208jw
208jx
208jy
208jz
208ka
208kb
208kc
208kd
208ke
208kf
208kg
208kh
208ki
208kj
208kk
208kl
208km
208kn
208ko
208kp
208kq
208kr
208ks
208kt
208ku
208kv
208kw
208kx
208ky
208kz
208la
208lb
208lc
208ld
208le
208lf
208lg
208lh
208li
208lj
208lk
208ll
208lm
208ln
208lo
208lp
208lq
208lr
208ls
208lt
208lu
208lv
208lw
208lx
208ly
208lz
208ma
208mb
208mc
208md
208me
208mf
208mg
208mh
208mi
208mj
208mk
208ml
208mm
208mn
208mo
208mp
208mq
208mr
208ms
208mt
208mu
208mv
208mw
208mx
208my
208mz
208na
208nb
208nc
208nd
208ne
208nf
208ng
208nh
208ni
208nj
208nk
208nl
208nm
208nn
208no
208np
208nq
208nr
208ns
208nt
208nu
208nv
208nw
208nx
208ny
208nz
208oa
208ob
208oc
208od
208oe
208of
208og
208oh
208oi
208oj
208ok
208ol
208om
208on
208oo
208op
208oq
208or
208os
208ot
208ou
208ov
208ow
208ox
208oy
208oz
208pa
208pb
208pc
208pd
208pe
208pf
208pg
208ph
208pi
208pj
208pk
208pl
208pm
208pn
208po
208pp
208pq
208pr
208ps
208pt
208pu
208pv
208pw
208px
208py
208pz
208qa
208qb
208qc
208qd
208qe
208qf
208qg
208qh
208qi
208qj
208qk
208ql
208qm
208qn
208qo
208qp
208qq
208qr
208qs
208qt
208qu
208qv
208qw
208qx
208qy
208qz
208ra
208rb
208rc
208rd
208re
208rf
208rg
208rh
208ri
208rj
208rk
208rl
208rm
208rn
208ro
208rp
208rq
208rr
208rs
208rt
208ru
208rv
208rw
208rx
208ry
208rz
208sa
208sb
208sc
208sd
208se
208sf
208sg
208sh
208si
208sj
208sk
208sl
208sm
208sn
208so
208sp
208sq
208sr
208ss
208st
208su
208sv
208sw
208sx
208sy
208sz
208ta
208tb
208tc
208td
208te
208tf
208tg
208th
208ti
208tj
208tk
208tl
208tm
208tn
208to
208tp
208tq
208tr
208ts
208tt
208tu
208tv
208tw
208tx
208ty
208tz
208ua
208ub
208uc
208ud
208ue
208uf
208ug
208uh
208ui
208uj
208uk
208ul
208um
208un
208uo
208up
208uq
208ur
208us
208ut
208uv
208uw
208ux
208uy
208uz
208va
208vb
208vc
208vd
208ve
208vf
208vg
208vh
208vi
208vj
208vk
208vl
208vm
208vn
208vo
208vp
208vq
208vr
208vs
208vt
208vu
208vv
208vw
208vx
208vy
208vz
208wa
208wb
208wc
208wd
208we
208wf
208wg
208wh
208wi
208wj
208wk
208wl
208wm
208wn
208wo
208wp
208wq
208wr
208ws
208wt
208wu
208wv
208ww
208wx
208wy
208wz
208xa
208xb
208xc
208xd
208xe
208xf
208xg
208xh
208xi
208xj
208xk
208xl
208xm
208xn
208xo
208xp
208xq
208xr
208xs
208xt
208xu
208xv
208xw
208xx
208xy
208xz
208ya
208yb
208yc
208yd
208ye
208yf
208yg
208yh
208yi
208yj
208yk
208yl
208ym
208yn
208yo
208yp
208yq
208yr
208ys
208yt
208yu
208yv
208yw
208yx
208yy
208yz
208za
208zb
208zc
208zd
208ze
208zf
208zg
208zh
208zi
208zj
208zk
208zl
208zm
208zn
208zo
208zp
208zq
208zr
208zs
208zt
208zu
208zv
208zw
208zx
208zy
208zz
208aaa
208aab
208aac
208aad
208aae
208aaf
208aag
208aah
208aai
208aaj
208aak
208aal
208aam
208aan
208aao
208aap
208aaq
208aar
208aas
208aat
208aau
208aav
208aaw
208aax
208aay
208aaz
208aba
208abb
208abc
208abd
208abe
208abf
208abg
208abh
208abi
208abj
208abk
208abl
208abm
208abn
208abo
208abp
208abq
208abr
208abs
208abt
208abu
208abv
208abw
208abx
208aby
208abz
208aca
208acb
208acc
208acd
208ace
208acf
208acg
208ach
208aci
208acj
208ack
208acl
208acm
208acn
208aco
208acp
208acq
208acr
208acs
208act
208acu
208acv
208acw
208acx
208acy
208acz
208ada
208adb
208adc
208add
208ade
208adf
208adg
208adh
208adi
208adj
208adk
208adl
208adm
208adn
208ado
208adp
208adq
208adr
208ads
208adt
208adu
208adv
208adw
208adx
208ady
208adz
208aea
208aeb
208aec
208aed
208aee
208aef
208aeg
208aeh
208aei
208aej
208aek
208ael
208aem
208aen
208aeo
208aep
208aeq
208aer
208aes
208aet
208aeu
208aev
208aew
208aex
208aey
208aez
208afa
208afb
208afc
208afd
208afe
208aff
208afg
208afh
208afi
208afj
208afk
208afl
208afm
208afn
208afo
208afp
208afq
208afr
208afs
208aft
208afu
208afv
208afw
208afx
208afy
208afz
208aga
208agb
208agc
208agd
208age
208agf
208agg
208agh
208agi
208agj
208agk
208agl
208agm
208agn
208ago
208agp
208agq
208agr
208ags
208agt
208agu
208agv
208agw
208agx
208agy
208agz
208aha
208ahb
208ahc
208ahd
208ahe
208ahf
208ahg
208ahh
208ahi
208ahj
208ahk
208ahl
208ahm
208ahn
208aho
208ahp
208ahq
208ahr
208ahs
208aht
208ahu
208ahv
208ahw
208ahx
208ahy
208ahz
208aia
208aib
208aic
208aid
208aie
208aif
208aig
208aih
208aii
208aij
208aik
208ail
208aim
208ain
208aio
208aip
208aiq
208air
208ais
208ait
208aiu
208aiv
208aiw
208aix
208aiy
208aiz
208aja
208ajb
208ajc
208ajd
208aje
208ajf
208ajg
208ajh
208aji
208ajj
208ajk
208ajl
208ajm
208ajn
208ajo
208ajp
208ajq
208ajr
208ajs
208ajt
208aju
208ajv
208ajw
208ajx
208ajy
208ajz
208aka
208akb
208akc
208akd
208ake
208akf
208akg
208akh
208aki
208akj
208akk
208akl
208akm
208akn
208ako
208akp
208akq
208akr
208aks
208akt
208aku
208akv
208akw
208akx
208aky
208akz
208ala
208alb
208alc
208ald
208ale
208alf
208alg
208alh
208ali
208alj
208alk
208all
208alm
208aln
208alo
208alp
208alq
208alr
208als
208alt
208alu
208alv
208alw
208alx
208aly
208alz
208ama
208amb
208amc
208amd
208ame
208amf
208amg
208amh
208ami
208amj
208amk
208aml
208amm
208amn
208amo
208amp
208amq
208amr
208ams
208amt
208amu
208amv
208amw
208amx
208amy
208amz
208ana
208anb
208anc
208and
208ane
208anf
208ang
208anh
208ani
208anj
208ank
208anl
208anm
208ann
208ano
208anp
208anq
208anr
208ans
208ant
208anu
208anv
208anw
208anx
208any
208anz
208aoa
208aob
208aoc
208aod
208aoe
208aof
208aog
208aoh
208aoi
208aoj
208aok
208aol
208aom
208aon
208aoo
208aop
208aoq
208aor
208aos
208aot
208aou
208aov
208aow
208aox
208aoy
208aoz
208apa
208apb
208apc
208apd
208ape
208apf
208apg
208aph
208api
208apj
208apk
208apl
208apm
208apn
208apo
208app
208apq
208apr
208aps
208apt
208apu
208apv
208apw
208apx
208apy
208apz
208aqa
208aqb
208aqc
208aqd
208aqe
208aqf
208aqg
208aqh
208aqi
208aqj
208aqk
208aql
208aqm
208aqn
208aqo
208aqp
208aqq
208aqr
208aqs
208aqt
208aqu
208aqv
208aqw
208aqx
208aqy
208aqz
208ara
208arb
208arc
208ard
208are
208arf
208arg
208arh
208ari
208arj
208ark
208arl
208arm
208arn
208aro
208arp
208arq
208arr
208ars
208art
208aru
208arv
208arw
208arx
208ary
208arz
208asa
208asb
208asc
208asd
208ase
208asf
208asg
208ash
208asi
208asj
208ask
208asl
208asm
208asn
208aso
208asp
208asq
208asr
208ass
208ast
208asu
208asv
208asw
208asx
208asy
208asz
208ata
208atb
208atc
208atd
208ate
208atf
208atg
208ath
208ati
208atj
208atk
208atl
208atm
208atn
208ato
208atp
208atq
208atr
208ats
208att
208atu
208atv
208atw
208atx
208aty
208atz
208aua
208aub
208auc
208aud
208aue
208auf
208aug
208auh
208aui
208auj
208auk
208aul
208aum
208aun
208auo
208aup
208auq
208aur
208aus
208aut
208auu
208auv
208auw
208aux
208auy
208auz
208ava
208avb
208avc
208avd
208ave
208avf
208avg
208avh
208avi
208avj
208avk
208avl
208avm
208avn
208avo
208avp
208avq
208avr
208avs
208avt
208avu
208avv
208avw
208avx
208avy
208avz
208awa
208awb
208awc
208awd
208awe
208awf
208awg
208awh
208awi
208awj
208awk
208awl
208awm
208awn
208awo
208awp
208awq
208awr
208aws
208awt
208awu
208awv
208aww
208awx
208awy
208awz
208axa
208axb
208axc
208axd
208axe
208axf
208axg
208axh
208axi
208axj
208axk
208axl
208axm
208axn
208axo
208axp
208axq
208axr
208axs
208axt
208axu
208axv
208axw
208axx
208axy
208axz
208aya
208ayb
208ayc
208ayd
208aye
208ayf
208ayg
208ayh
208ayi
208ayj
208ayk
208ayl
208aym
208ayn
208ayo
208ayp
208ayq
208ayr
208ays
208ayt
208ayu
208ayv
208ayw
208ayx
208ayy
208ayz
208aza
208azb
208azc
208azd
208aze
208azf
208azg
208azh
208azi
208azj
208azk
208azl
208azm
208azn
208azo
208azp
208azq
208azr
208azs
208azt
208azu
208azv
208azw
208azx
208azy
208azz
208baa
208bab
208bac
208bad
208bae
208baf
208bag
208bah
208bai
208baj
208bak
208bal
208bam
208ban
208bao
208bap
208baq
208bar
208bas
208bat
208bau
208bav
208baw
208bax
208bay
208baz
208bba
208bbb
208bbc
208bbd
208bbe
208bbf
208bbg
208bbh
208bbi
208bbj
208bbk
208bbl
208bbm
208bbn
208bbo
208bbp
208bbq
208bbr
208bbs
208bbt
208bbu
208bbv
208bbw
208bbx
208bby
208bbz
208bca
208bcb
208bcc
208bcd
208bce
208bcf
208bcg
208bch
208bci
208bcj
208bck
208bcl
208bcm
208bcn
208bco
208bcp
208bcq
208bcr
208bcs
208bct
208bcu
208bcv
208bcw
208bcx
208bcy
208bcz
208cda
208cdb
208cdc
208cdd
208cde
208cdf
208cdg
208cdh
208cdi
208cdj
208cdk
208cdl
208cdm
208cdn
208cdo
208cdp
208cdq
208cdr
208cds
208cdt
208cdu
208cdv
208cdw
208cdx
208cdy
208cdz
208cea
208ceb
208cec
208ced
208cee
208cef
208ceg
208ceh
208cei
208cej
208cek
208cel
208cem
208cen
208ceo
208cep
208ceq
208cer
208ces
208cet
208ceu
208cev
208cew
208cex
208cey
208cez
208cfa
208cfb
208cfc
208cfd
208cfe
208cff
208cfg
208cfh
208cfi
208cfj
208cfk
208cfl
208cfm
208cfn
208cfo
208cfp
208cfq
208cfr
208cfs
208cft
208cfu
208cfv
208cfw
208cfx
208cfy
208cfz
208cga
208cgb
208cgc
208cgd
208cge
208cgf
208cgg
208cgh
208cgi
208cgj
208cgk
208cgl
208cgm
208cgn
208cgo
208cgp
208cgq
208cgr
208cgs
208cgt
208cgu
208cgv
208cgw
208cgx
208cgy
208cgz
208cha
208chb
208chc
208chd
208che
208chf
208chg
208chh
208chi
208chj
208chk
208chl
208chm
208chn
208cho
208chp
208chq
208chr
208chs
208cht
208chu
208chv
208chw
208chx
208chy
208chz
208cia
208cib
208cic
208cid
208cie
208cif
208cig
208cih
208cii
208cij
208cik
208cil
208cim
208cin
208cio
208cip
208ciq
208cir
208cis
208cit
208ciu
208civ
208ciw
208cix
208ciy
208ciz
208cja
208cjb
208cjc
208cjd
208cje
208cjf
208cjg
208cjh
208cji
208cjj
208cjk
208cjl
208cjm
208cjn
208cjo
208cjp
208cjq
208cjr
208cjs
208cjt
208cju
208cjv
208cjw
208cjx
208cjy
208cjz
208cka
208ckb
208ckc
208ckd
208cke
208ckf
208ckg
208ckh
208cki
208ckj
208ckk
208ckl
208ckm
208ckn
208cko
208ckp
208ckq
208ckr
208cks
208ckt
208cku
208ckv
208ckw
208ckx
208cky
208ckz
208cla
208clb
208clc
208cld
208cle
208clf
208clg
208clh
208cli
208clj
208clk
208cll
208clm
208cln
208clo
208clp
208clq
208clr
208cls
208clt
208clu
208clv
208clw
208clx
208cly
208clz
208cma
208cmb
208cmc
208cmd
208cme
208cmf
208cmg
208cmh
208cmi
208cmj
208cmk
208cml
208cmm
208cmn
208cmo
208cmp
208cmq
208cmr
208cms
208cmt
208cmu
208cmv
208cmw
208cmx
208cmy
208cmz
208cna
208cnb
208cnc
208cnd
208cne
208cnf
208cng
208cnh
208cni
208cnj
208cnk
208cnl
208cnm
208cnn
208cno
208cnp
208cnq
208cnr
208cns
208cnt
208cnu
208cnv
208cnw
208cnx
208cny
208cnz
208coa
208cob
208coc
208cod
208coe
208cof
208cog
208coh
208coi
208coj
208cok
208col
208com
208con
208coo
208cop
208coq
208cor
208cos
208cot
208cou
208cov
208cow
208cox
208coy
208coz
208cpa
208cpb
208cpc
208cpd
208cpe
208cpf
208cpg
208cph
208cpi
208cpj
208cpk
208cpl
208cpm
208cpn
208cpo
208cpp
208cpq
208cpr
208cps
208cpt
208cpu
208cpv
208cpw
208cpx
208cpy
208cpz
208cqa
208cqb
208cqc
208cqd
208cqe
208cqf
208cqg
208cqh
208cqi
208cqj
208cqk
208cql
208cqm
208cqn
208cqo
208cqp
208cqq
208cqr
208cqs
208cqt
208cqu
208cqv
208cqw
208cqx
208cqy
208cqz
208cra
208crb
208crc
208crd
208cre
208crf
208crg
208crh
208cri
208crj
208crk
208crl
208crm
208crn
208cro
208crp
208crq
208crr
208crs
208crt
208cru
208crv
208crw
208crx
208cry
208crz
208csa
208csb
208csc
208csd
208cse
208csf
208csg
208csh
208csi
208csj
208csk
208csl
208csm
208csn
208cso
208csp
208csq
208csr
208css
208cst
208csu
208csv
208csw
208csx
208csy
208csz
208cta
208ctb
208ctc
208ctd
208cte
208ctf
208ctg
208cth
208cti
208ctj
208ctk
208ctl
208ctm
208ctn
208cto
208ctp
208ctq
208ctr
208cts
208ctt
208ctu
208ctv
208ctw
208ctx
208cty
208ctz
208cua
208cub
208cuc
208cud
208cue
208cuf
208cug
208cuh
208cui
208cuj
208cuk
208cul
208cum
208cun
208cuo
208cup
208cuq
208cur
208cus
208cut
208cuu
208cuv
208cuw
208cux
208cuy
208cuz
208cva
208cvb
208cvc
208cvd
208cve
208cvf
208cvg
208cvh
208cvi
208cvj
208cvk
208cvl
208cvm
208cvn
208cvo
208cvp
208cvq
208cvr
208cvs
208cvt
208cvu
208cvv
208cvw
208cvx
208cvy
208cvz
208cwa
208cwb
208cwc
208cwd
208cwe
208cwf
208cwg
208cwh
208cwi
208cwj
208cwk
208cwl
208cwm
208cwn
208cwo
208cwp
208cwq
208cwr
208cws
208cwt
208cwu
208cwv
208cww
208cwx
208cwy
208cwz
208cxa
208cxb
208cxc
208cxd
208cxe
208cxf
208cxg
208cxh
208cxi
208cxj
208cxk
208cxl
208cxm
208cxn
208cxo
208cxp
208cxq
208cxr
208cxs
208cxt
208cxu
208cxv
208cxw
208cxx
208cxy
208cxz
208cya
208cyb
208cyc
208cyd
208cye
208cyf
208cyg
208cyh
208cyi
208cyj
208cyk
208cyl
208cym
208cyn
208cyo
208cyp
208cyq
208cyr
208cys
208cyt
208cyu
208cyv
208cyw
208cyx
208cyy
208cyz
208cza
208czb
208czc
208czd
208cze
208czf
208czg
208czh
208czi
208czj
208czk
208czl
208czm
208czn
208czo
208czp
208czq
208czr
208czs
208czt
208czu
208czv
208czw
208czx
208czy
208czz
208daa
208dab
208dac
208dad
208dae
208daf
208dag
208dah
208dai
208daj
208dak
208dal
208dam
208dan
208dao
208dap
208daq
208dar
208das
208dat
208dau
208dav
208daw
208dax
208day
208daz
208dba
208dbb
208dbc
208dbd
208dbe
208dbf
208dbg
208dbh
208dbi
208dbj
208dbk
208dbl
208dbm
208dbn
208dbo
208dbp
208dbq
208dbr
208dbs
208dbt
208dbu
208dbv
208dbw
208dbx
208dby
208dbz
208dca
208dcb
208dcc
208dcd
208dce
208dcf
208dcg
208dch
208dci
208dcj
208dck
208dcl
208dcm
208dcn
208dco
208dcp
208dcq
208dcr
208dcs
208dct
208dcu
208dcv
208dcw
208dcx
208dcy
208dcz
208dda
208ddb
208ddc
208ddd
208dde
208ddf
208ddg
208ddh
208ddi
208ddj
208ddk
208ddl
208ddm
208ddn
208ddo
208ddp
208ddq
208ddr
208dds
208ddt
208ddu
208ddv
208ddw
208ddx
208ddy
208ddz
208dea
208deb
208dec
208ded
208dee
208def
208deg
208deh
208dei
208dej
208dek
208del
208dem
208den
208deo
208dep
208deq
208der
208des
208det
208deu
208dev
208dew
208dex
208dey
208dez
208dfa
208dfb
208dfc
208dfd
208dfe
208dff
208dfg
208dfh
208dfi
208dfj
208dfk
208dfl
208dfm
208dfn
208dfo
208dfp
208dfq
208dfr
208dfs
208dft
208dfu
208dfv
208dfw
208dfx
208dfy
208dfz
208dga
208dgb
208dgc
208dgd
208dge
208dgf
208dgg
208dgh
208dgi
208dgj
208dgk
208dgl
208dgm
208dgn
208dgo
208dgp
208dgq
208dgr
208dgs
208dgt
208dgu
208dgv
208dgw
208dgx
208dgy
208dgz
208dha
208dhb
208dhc
208dhd
208dhe
208dhf
208dhg
208dhh
208dhi
208dhj
208dhk
208dhl
208dhm
208dhn
208dho
208dhp
208dhq
208dhr
208dhs
208dht
208dhu
208dhv
208dhw
208dhx
208dhy
208dhz
208dia
208dib
208dic
208did
208die
208dif
208dig
208dih
208dii
208dij
208dik
208dil
208dim
208din
208dio
208dip
208diq
208dir
208dis
208dit
208diu
208div
208diw
208dix
208diy
208diz
208dja
208djb
208djc
208djd
208dje
208djf
208djg
208djh
208dji
208djj
208djk
208djl
208djm
208djn
208djo
208djp
208djq
208djr
208djs
208djt
208dju
208djv
208djw
208djx
208djy
208djz
208dka
208dkb
208dkc
208dkd
208dke
208dkf
208dkg
208dkh
208dki
208dkj
208dkk
208dkl
208dkm
208dkn
208dko
208dkp
208dkq
208dkr
208dks
208dkt
208dku
208dkv
208dkw
208dkx
208dky
208dkz
208dla
208dlb
208dlc
208dld
208dle
208dlf
208dlg
208dlh
208dli
208dlj
208dlk
208dll
208dlm
208dln
208dlo
208dlp
208dlq
208dlr
208dls
208dlt
208dlu
208dlv
208dlw
208dlx
208dly
208dlz
208dma
208dmb
208dmc
208dmd
208dme
208dmf
208dmg
208dmh
208dmi
208dmj
208dmk
208dml
208dmm
208dmn
208dmo
208dmp
208dmq
208dmr
208dms
208dmt
208dmu
208dmv
208dmw
208dmx
208dmy
208dmz
208dna
208dnb
208dnc
208dnd
208dne
208dnf
208dng
208dnh
208dni
208dnj
208dnk
208dnl
208dnm
208dnn
208dno
208dnp
208dnq
208dnr
208dns
208dnt
208dnu
208dnv
208dnw
208dnx
208dny
208dnz
208doa
208dob
208doc
208dod
208doe
208dof
208dog
208doh
208doi
208doj
208dok
208dol
208dom
208don
208doo
208dop
208doq
208dor
208dos
208dot
208dou
208dov
208dow
208dox
208doy
208doz
208dpa
208dpb
208dpc
208dpd
208dpe
208dpf
208dpg
208dph
208dpi
208dpj
208dpk
208dpl
208dpm
208dpn
208dpo
208dpp
208dpq
208dpr
208dps
208dpt
208dpu
208dpv
208dpw
208dpx
208dpy
208dpz
208dqa
208dqb
208dqc
208dqd
208dqe
208dqf
208dqg
208dqh
208dqi
208dqj
208dqk
208dql
208dqm
208dqn
208dqo
208dqp
208dqq
208dqr
208dqs
208dqt
208dqu
208dqv
208dqw
208dqx
208dqy
208dqz
208dra
208drb
208drc
208drd
208dre
208drf
208drg
208drh
208dri
208drj
208drk
208drl
208drm
208drn
208dro
208drp
208drq
208drr
208drs
208drt
208dru
208drv
208drw
208drx
208dry
208drz
208dsa
208dsb
208dsc
208dsd
208dse
208dsf
208dsg
208dsh
208dsi
208dsj
208dsk
208dsl
208dsm
208dsn
208dso
208dsp
208dsq
208dsr
208dss
208dst
208dsu
208dsv
208dsw
208dsx
208dsy
208dsz
208dta
208dtb
208dtc
208dtd
208dte
208dtf
208dtg
208dth
208dti
208dtj
208dtk
208dtl
208dtm
208dtn
208dto
208dtp
208dtq
208dtr
208dts
208dtt
208dtu
208dtv
208dtw
208dtx
208dty
208dtz
208dua
208dub
208duc
208dud
208due
208duf
208dug
208duh
208dui
208duj
208duk
208dul
208dum
208dun
208duo
208dup
208duq
208dur
208dus
208dut
208duu
208duv
208duw
208dux
208duy
208duz
208dva
208dvb
208dvc
208dvd
208dve
208dvf
208dvg
208dvh
208dvi
208dvj
208dvk
208dvl
208dvm
208dvn
208dvo
208dvp
208dvq
208dvr
208dvs
208dvt
208dvu
208dvv
208dvw
208dvx
208dvy
208dvz
208dwa
208dwb
208dwc
208dwd
208dwe
208dwf
208dwg
208dwh
208dwi
208dwj
208dwk
208dwl
208dwm
208dwn
208dwo
208dwp
208dwq
208dwr
208dws
208dwt
208dwu
208dwv
208dww
208dwx
208dwy
208dwz
208dxa
208dxb
208dxc
208dxd
208dxe
208dxf
208dxg
208dxh
208dxi
208dxj
208dxk
208dxl
208dxm
208dxn
208dxo
208dxp
208dxq
208dxr
208dxs
208dxt
208dxu
208dxv
208dxw
208dxx
208dxy
208dxz
208dya
208dyb
208dyc
208dyd
208dye
208dyf
208dyg
208dyh
208dyi
208dyj
208dyk
208dyl
208dym
208dyn
208dyo
208dyp
208dyq
208dyr
208dys
208dyt
208dyu
208dyv
208dyw
208dyx
208dyy
208dyz
208dza
208dzb
208dzc
208dzd
208dze
208dzf
208dzg
208dzh
208dzi
208dzj
208dzk
208dzl
208dzm
208dzn
208dzo
208dzp
208dzq
208dzr
208dzs
208dzt
208dzu
208dzv
208dzw
208dzx
208dzy
208dzz
208eaa
208eab
208eac
208ead
208eae
208eaf
208eag
208eah
208eai
208eaj
208eak
208eal
208eam
208ean
208eao
208eap
208eaq
208ear
208eas
208eat
208eau
208eav
208eaw
208eax
208eay
208eaz
208eba
208ebb
208ebc
208ebd
208ebe
208ebf
208ebg
208ebh
208ebi
208ebj
208ebk
208ebl
208ebm
208ebn
208ebo
208ebp
208ebq
208ebr
208ebs
208ebt
208ebu
208ebv
208ebw
208ebx
208eby
208ebz
208eca
208ecb
208ecc
208ecd
208ece
208ecf
208ecg
208ech
208eci
208ecj
208eck
208ecl
208ecm
208ecn
208eco
208ecp
208ecq
208ecr
208ecs
208ect
208ecu
208ecv
208ecw
208ecx
208ecy
208ecz
208eda
208edb
208edc
208edd
208ede
208edf
208edg
208edh
208edi
208edj
208edk
208edl
208edm
208edn
208edo
208edp
208edq
208edr
208eds
208edt
208edu
208edv
208edw
208edx
208edy
208edz
208eea
208eeb
208eec
208eed
208eee
208eef
208eeg
208eeh
208eei
208eej
208eek
208eel
208eem
208een
208eeo
208eep
208eeq
208eer
208ees
208eet
208eeu
208eev
208eew
208eex
208eey
208eez
208efa
208efb
208efc
208efd
208efe
208eff
208efg
208efh
208efi
208efj
208efk
208efl
208efm
208efn
208efo
208efp
208efq
208efr
208efs
208eft
208efu
208efv
208efw
208efx
208efy
208efz
208ega
208egb
208egc
208egd
208ege
208egf
208egg
208egh
208egi
208egj
208egk
208egl
208egm
208egn
208ego
208egp
208egq
208egr
208egs
208egt
208egu
208egv
208egw
208egx
208egy
208egz
208eha
208ehb
208ehc
208ehd
208ehe
208ehf
208ehg
208ehh
208ehi
208ehj
208ehk
208ehl
208ehm
208ehn
208eho
208ehp
208ehq
208ehr
208ehs
208eht
208ehu
208ehv
208ehw
208ehx
208ehy
208ehz
208eia
208eib
208eic
208eid
208eie
208eif
208eig
208eih
208eii
208eij
208eik
208eil
208eim
208ein
208eio
208eip
208eiq
208eir
208eis
208eit
208eiu
208eiv
208eiw
208eix
208eiy
208eiz
208eja
208ejb
208ejc
208ejd
208eje
208ejf
208ejg
208ejh
208eji
208ejj
208ejk
208ejl
208ejm
208ejn
208ejo
208ejp
208ejq
208ejr
208ejs
208ejt
208eju
208ejv
208ejw
208ejx
208ejy
208ejz
208eka
208ekb
208ekc
208ekd
208eke
208ekf
208ekg
208ekh
208eki
208ekj
208ekk
208ekl
208ekm
208ekn
208eko
208ekp
208ekq
208ekr
208eks
208ekt
208eku
208ekv
208ekw
208ekx
208eky
208ekz
208ela
208elb
208elc
208eld
208ele
208elf
208elg
208elh
208eli
208elj
208elk
208ell
208elm
208eln
208elo
208elp
208elq
208elr
208els
208elt
208elu
208elv
208elw
208elx
208ely
208elz
208ema
208emb
208emc
208emd
208eme
208emf
208emg
208emh
208emi
208emj
208emk
208eml
208emm
208emn
208emo
208emp
208emq
208emr
208ems
208emt
208emu
208emv
208emw
208emx
208emy
208emz
208ena
208enb
208enc
208end
208ene
208enf
208eng
208enh
208eni
208enj
208enk
208enl
208enm
208enn
208eno
208enp
208enq
208enr
208ens
208ent
208enu
208env
208enw
208enx
208eny
208enz
208eoa
208eob
208eoc
208eod
208eoe
208eof
208eog
208eoh
208eoi
208eoj
208eok
208eol
208eom
208eon
208eoo
208eop
208eoq
208eor
208eos
208eot
208eou
208eov
208eow
208eox
208eoy
208eoz
208epa
208epb
208epc
208epd
208epe
208epf
208epg
208eph
208epi
208epj
208epk
208epl
208epm
208epn
208epo
208epp
208epq
208epr
208eps
208ept
208epu
208epv
208epw
208epx
208epy
208epz
208eqa
208eqb
208eqc
208eqd
208eqe
208eqf
208eqg
208eqh
208eqi
208eqj
208eqk
208eql
208eqm
208eqn
208eqo
208eqp
208eqq
208eqr
208eqs
208eqt
208equ
208eqv
208eqw
208eqx
208eqy
208eqz
208era
208erb
208erc
208erd
208ere
208erf
208erg
208erh
208eri
208erj
208erk
208erl
208erm
208ern
208ero
208erp
208erq
208err
208ers
208ert
208eru
208erv
208erw
208erx
208ery
208erz
208esa
208esb
208esc
208esd
208ese
208esf
208esg
208esh
208esi
208esj
208esk
208esl
208esm
208esn
208eso
208esp
208esq
208esr
208ess
208est
208esu
208esv
208esw
208esx
208esy
208esz
208eta
208etb
208etc
208etd
208ete
208etf
208etg
208eth
208eti
208etj
208etk
208etl
208etm
208etn
208eto
208etp
208etq
208etr
208ets
208ett
208etu
208etv
208etw
208etx
208ety
208etz
208eua
208eub
208euc
208eud
208eue
208euf
208eug
208euh
208eui
208euj
208euk
208eul
208eum
208eun
208euo
208eup
208euq
208eur
208eus
208eut
208euu
208euv
208euw
208eux
208euy
208euz
208eva
208evb
208evc
208evd
208eve
208evf
208evg
208evh
208evi
208evj
208evk
208evl
208evm
208evn
208evo
208evp
208evq
208evr
208evs
208evt
208evu
208evv
208evw
208evx
208evy
208evz
208ewa
208ewb
208ewc
208ewd
208ewe
208ewf
208ewg
208ewh
208ewi
208ewj
208ewk
208ewl
208ewm
208ewn
208ewo
208ewp
208ewq
208ewr
208ews
208ewt
208ewu
208ewv
208eww
208ewx
208ewy
208ewz
208exa
208exb
208exc
208exd
208exe
208exf
208exg
208exh
208exi
208exj
208exk
208exl
208exm
208exn
208exo
208exp
208exq
208exr
208exs
208ext
208exu
208exv
208exw
208exx
208exy
208exz
208eya
208eyb
208eyc
208eyd
208eye
208eyf
208eyg
208eyh
208eyi
208eyj
208eyk
208eyl
208eym
208eyn
208eyo
208eyp
208eyq
208eyr
208eys
208eyt
208eyu
208eyv
208eyw
208eyx
208eyy
208eyz
208eza
208ezb
208ezc
208ezd
208eze
208ezf
208ezg
208ezh
208ezi
208ezj
208ezk
208ezl
208ezm
208ezn
208ezo
208ezp
208ezq
208ezr
208ezs
208ezt
208ezu
208ezv
208ezw
208ezx
208ezy
208ezz
208faa
208fab
208fac
208fad
208fae
208faf
208fag
208fah
208fai
208faj
208fak
208fal
208fam
208fan
208fao
208fap
208faq
208far
208fas
208fat
208fau
208fav
208faw
208fax
208fay
208faz
208fba
208fbb
208fbc
208fbd
208fbe
208fbf
208fbg
208fbh
208fbi
208fbj
208fbk
208fbl
208fbm
208fbn
208fbo
208fbp
208fbq
208fbr
208fbs
208fbt
208fbu
208fbv
208fbw
208fbx
208fby
208fbz
208fca
208fcb
208fcc
208fcd
208fce
208fcf
208fcg
208fch
208fci
208fcj
208fck
208fcl
208fcm
208fcn
208fco
208fcp
208fcq
208fcr
208fcs
208fct
208fcu
208fcv
208fcw
208fcx
208fcy
208fcz
208fda
208fdb
208fdc
208fdd
208fde
208fdf
208fdg
208fdh
208fdi
208fdj
208fdk
208fdl
208fdm
208fdn
208fdo
208fdp
208fdq
208fdr
208fds
208fdt
208fdu
208fdv
208fdw
208fdx
208fdy
208fdz
208fea
208feb
208fec
208fed
208fee
208fef
208feg
208feh
208fei
208fej
208fek
208fel
208fem
208fen
208feo
208fep
208feq
208fer
208fes
208fet
208feu
208fev
208few
208fex
208fey
208fez
208ffa
208ffb
208ffc
208ffd
208ffe
208fff
208ffg
208ffh
208ffi
208ffj
208ffk
208ffl
208ffm
208ffn
208ffo
208ffp
208ffq
208ffr
208ffs
208fft
208ffu
208ffv
208ffw
208ffx
208ffy
208ffz
208fga
208fgb
208fgc
208fgd
208fge
208fgf
208fgg
208fgh
208fgi
208fgj
208fgk
208fgl
208fgm
208fgn
208fgo
208fgp
208fgq
208fgr
208fgs
208fgt
208fgu
208fgv
208fgw
208fgx
208fgy
208fgz
208fha
208fhb
208fhc
208fhd
208fhe
208fhf
208fhg
208fhh
208fhi
208fhj
208fhk
208fhl
208fhm
208fhn
208fho
208fhp
208fhq
208fhr
208fhs
208fht
208fhu
208fhv
208fhw
208fhx
208fhy
208fhz
208fia
208fib
208fic
208fid
208fie
208fif
208fig
208fih
208fii
208fij
208fik
208fil
208fim
208fin
208fio
208fip
208fiq
208fir
208fis
208fit
208fiu
208fiv
208fiw
208fix
208fiy
208fiz
208fja
208fjb
208fjc
208fjd
208fje
208fjf
208fjg
208fjh
208fji
208fjj
208fjk
208fjl
208fjm
208fjn
208fjo
208fjp
208fjq
208fjr
208fjs
208fjt
208fju
208fjv
208fjw
208fjx
208fjy
208fjz
208fka
208fkb
208fkc
208fkd

REFRACTIVE OPTICS TO PROVIDE UNIFORM ILLUMINATION IN A DISPLAY CASE

CROSS-REFERENCE TO RELATED APPLICATION

This application claims the benefit of U.S. Provisional Application No. 61/255,287, filed Oct. 27, 2009, incorporated herein by reference in its entirety.

BACKGROUND

The present exemplary embodiments relate generally to lighting assemblies. They find particular application in conjunction with lighting display cases (e.g., commercial refrigerated display cases), and will be described with particular reference thereto. However, it is to be appreciated that the present exemplary embodiments are also amenable to other like applications.

Lighting assemblies are used to illuminate display cases, such as commercial refrigeration display cases, as well as other display cases that need not be refrigerated. Typically lighting assemblies use a fluorescent tube to illuminate products disposed in a display case. However, fluorescent tubes are being phased out in favor of LED technology.

Fluorescent tubes do not have nearly as long a lifetime as typical LED, and, for at least refrigerated display cases, initiating the required arc to illuminate a fluorescent tube is difficult. Even more, fluorescent tubes are relatively inefficient by comparison to LEDs, since fluorescent tubes produce more heat than LEDs and provide less control over the direction of light.

Known lighting assemblies often suffer from a number of problems when it comes to lighting display cases. As discussed below, these problems may include issues pertaining to efficiency, lighting uniformity, consumer appeal, customization and maintenance.

Lighting assemblies often allow light to escape the display case and bleed out into the external environment. However, this light could be put to better use lighting the item(s) on display, whereby less powerful and/or or fewer light sources could be employed.

Further, lighting assemblies generally do not uniformly light a display case. Namely, such assemblies generally fail to direct enough light to the center of a display case, resulting in much higher luminance in front of a mullion, as compared to the center of the display case. However, uniform luminance is preferable as it makes more efficient use of the available luminance and may allow fewer light sources and/or less powerful light sources.

Additionally, the optics and/or light sources of lighting assemblies are often visible to consumers. However, consumer tests have found it desirable to keep optics and/or light sources of a lighting assembly outside the view of an onlooker of the display case.

Even more, existing lighting assemblies are generally constructed with a fixed configuration in mind, whereby changing the configuration requires a mechanical and/or electrical redesign. However, this can add unnecessary expense when unconventional configurations are needed.

Further, existing lighting assemblies generally lack any way to replace components. When a component fails, the entire lighting assembly generally needs to be replaced. This can prove costly for one operating a large number of light assemblies.

The present disclosure contemplates new and improved systems and/or methods addressing these, and other, problems.

BRIEF DESCRIPTION

Various details of the present disclosure are hereinafter summarized to provide a basic understanding. This summary is not an extensive overview of the disclosure and is intended neither to identify certain elements of the disclosure, nor to delineate the scope thereof. Rather, the primary purpose of the summary is to present certain concepts of the disclosure in a simplified form prior to the more detailed description that is presented hereinafter.

According to one aspect of the present disclosure, a lighting assembly for illuminating a display case is provided. The lighting assembly includes an elongated frame and a plurality of modular inserts. The modular inserts are removably connected to the elongated frame and include a plurality of light modules. Each of the plurality of light modules is removably coupled to adjacent light modules electrically.

According to another aspect of the present disclosure, a lighting assembly for illuminating a display case is provided. The lighting assembly is mounted to the display case and includes a visibility envelope within which an onlooker of the display case cannot see. The assembly includes a light source and an optical lens disposed over and/or around the light source. The optical lens is disposed exclusively within the visibility envelope and fashioned to control light emitted from the light source using refraction and total internal reflection.

According to another aspect of the present disclosure, a lighting assembly for illuminating a display case is provided. The lighting assembly is mounted to the display case and includes a visibility envelop within which an onlooker of the display case cannot see. The assembly includes an elongated frame provisioned to receive modular inserts and at least one modular insert operatively connected to the elongated frame. The at least one modular insert includes a light module having an optical lens and a light source, where the optical lens is disposed over and/or around the light source and exclusively within the visibility envelope, wherein the optical lens is fashioned to control light emitted from the light source using refraction and total internal reflection.

According to another aspect of the present disclosure, a lighting assembly for illuminating a display case is provided. The lighting assembly includes an elongated frame and a plurality of modular inserts removably connected to the elongated frame. The plurality of modular inserts include a plurality of spacers and a plurality of LED modules, where the plurality of LED modules are spaced along the length of the elongated frame using the plurality of spacers. Each of said plurality of LED modules is removably coupled to adjacent LED modules electrically.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrative examples, however, are not exhaustive of the many possible embodiments of the disclosure. Other objects, advantages and novel features of the disclosure will be set forth in the following detailed description of the disclosure when considered in conjunction with the drawings, in which:

FIG. 8 is an exploded view of a lighting assembly;

DETAILED DESCRIPTION

Figure 1:
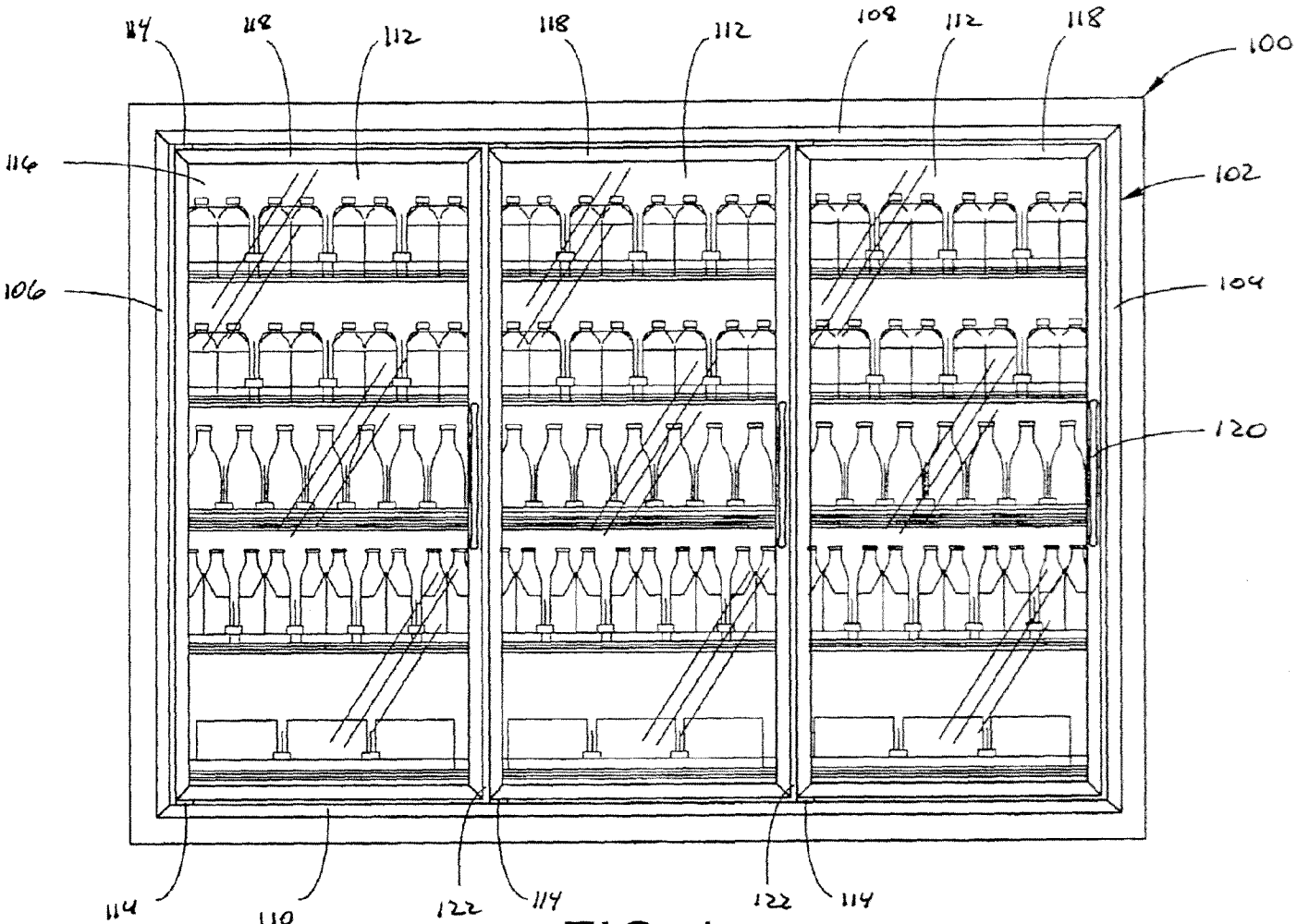
FIG. 1 is a plan view of a commercial refrigeration display case.

One or more embodiments or implementations are hereinafter described in conjunction with the drawings, where like reference numerals are used to refer to like elements throughout, and where the various features are not necessarily drawn to scale.

With reference to FIG. 1, a typical refrigerated display case 100 is illustrated. The refrigerated display case 100 has a door and frame assembly 102 mounted to a front portion of the case 100. The door and frame assembly 102 includes side frame members 104, 106 and top and bottom frame members 108, 110 that interconnect the side frame members 104, 106. Doors 112 mount to the frame members 104, 106, 108, 110 via hinges 114. The doors 112 include glass panels 116 retained in frames 118 and handles 120 may be provided on the doors. Mullions 122 mount to the top and bottom frame members 108, 110 to provide door stops and points of attachment for the doors 112 and/or hinges 114.

The lighting assemblies disclosed herein may suitably be employed within a display case, such as the refrigerated display case 100, as well as in a multitude of other applications. Further, the display case may employ different configurations than the refrigerated display case 100. For example, the display case may be a refrigerated display case lacking doors. As another example, the display case may be free-standing or a built-in display case.

Figure 2:
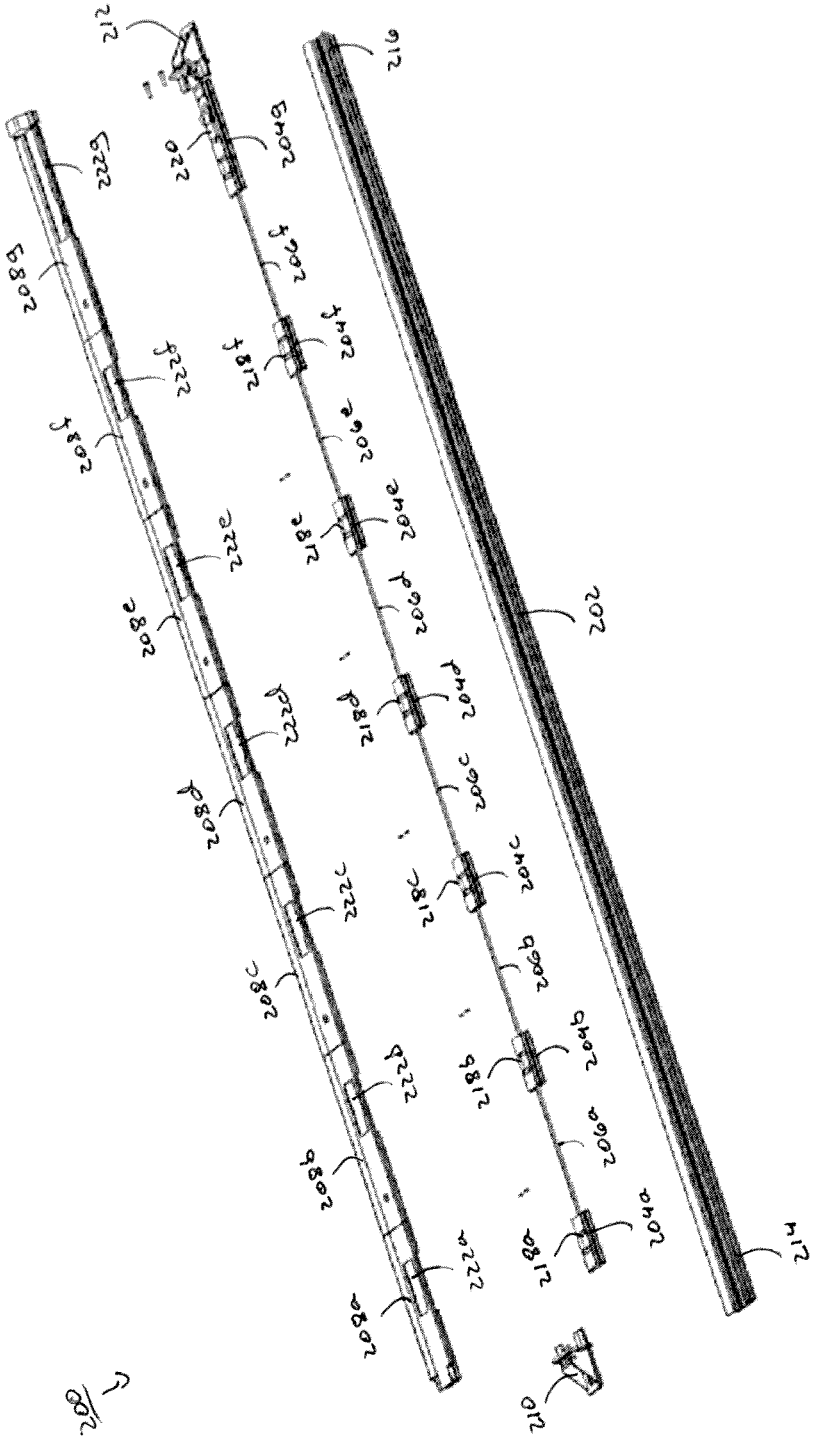
FIG. 2 is an exploded view of a lighting assembly.

With reference to FIG. 2, an exploded view of a lighting assembly 200 is illustrated. The lighting assembly 200 may include an elongated frame 202, one or more modules 204, one or more electrical cables 206, one or more spacers 208, end caps 210, 212, and a cover (not shown). Suitably, the lighting assembly 200 mounts vertically to a standard mullion, such as the mullion 122 depicted in FIG. 1, and therefore may have a width that is substantially equal to a standard mullion.

The frame 202 substantially defines the body of the lighting assembly 200 and provides a structure on which to secure the modules 204 and/or the spacers 208. The modules 204 and/or the spacers 208 are hereafter referred to as the modular inserts. Suitably, the modular inserts are slidingly secured to the frame 202 via a channel defined by opposing grooves running along the length of the frame 202. In such embodiments, each of the modular inserts includes opposing tabs that interlock with the opposing grooves, thereby limiting the range of motion of the modular inserts to motion along the length of the frame 202. The end caps 210, 212 then prevent the modular inserts from sliding out of the frame 202.

Figure 3:
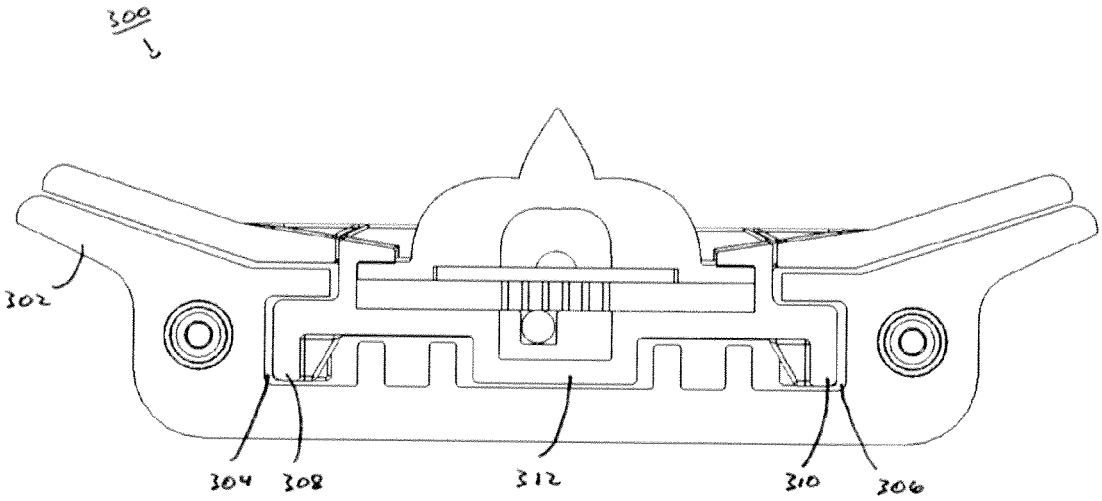
FIG. 3 is a cross sectional view of a lighting assembly.

Referring to FIG. 3, a cross sectional view of a lighting assembly 300 illustrates the interlocking system of grooves and tabs. Therein, a frame 302 of the lighting assembly 300 includes opposing grooves 304, 306 extending along the length of the frame 302. Opposing tabs 308, 310 on a modular insert 312 then interlock with the grooves 304, 306, so as to limit motion of the modular insert 312 to motion along the length of the frame 302.

Referring back to FIG. 2, the frame 202 is preferably comprised of a polymeric material, so as to reduce costs associated with the lighting assembly 200. However, the frame 202 need not necessarily be polymeric, whereby the frame 202 may, for example, be comprised of a thermally conductive material, such as aluminum, so as to act as a heat sink and facilitate the transfer heat away from the lighting assembly 200.

The modules 204 are suitably white so as to reflect light away from the modules 204, but other colors are equally amenable. Further, the modules 204 are suitably comprised of a polymeric material, so as to reduce costs associated with the lighting assembly 200, but other materials equally amenable. For example, as with the frame 202, the modules 204 may be comprised of a thermally conductive material, such as aluminum, so as to act as a heat sink and facilitate the transfer heat away from the lighting assembly 200.

So that power may be transferred from one end 214, 216 of the lighting assembly 200 to the other end 214, 216 of the lighting assembly 200, the modules 204 may be interconnected with one or more electrical cables 206. The electrical cables 206 may run through grooves on the bottom of the modules 204 and/or the spacers 208. Additionally, or alternatively, the electrical cables 206 may be disposed within the modules 204 and/or the spacers 206. In such embodiments, each module and/or spacer preferably has an electrical cable running therethrough between a pair of connectors, where the connectors of adjacent modules and/or spacers are provisioned to mechanically couple to one another and electrically connect the individual electrical cables.

The modules 204 may include at least one of one or more light modules 218, one or more power modules 220, and the like. The light modules 218 may provide illumination to a display case and may include one or more light sources. Suitably, the light sources include one or more LEDs. The power modules 220 may provide illumination to a display case and/or provide power to the light modules 218. Suitably, the power modules 220 receive power from an external power source and are disposed on the distal ends 214, 216 of the frame 202, so as to easily receive power from the external power source. The power modules 220 may include one or more of a light module, a power regulating circuit, a power conditioning circuit, and the like.

The power regulating circuit regulates the flow of current through the modules 204 so as to allow the lighting assembly 200 to dynamically adapt to an increased load; for example, an additional light module. Preferably, this is accomplished with a simple DC-DC converter, but other means of accomplishing this are equally amenable.

The power conditioning circuit may convert alternating current voltage to a direct current voltage. For example, the power conditioning circuit may convert 120 or 240 volt alternating current voltage to a direct current voltage. The power conditioning circuit may additionally, or alternatively, correct for polarity of the incoming power so that the power supply wires that connect to the power module 220 can be connected without having to worry about which wire connects to which element of the power conditioning circuit.

The spacers 208 serve to orient the modules 204 within the frame 202 and suitably include openings 222 for receiving the modules 204. For example, a spacer module 208*a* may include an opening 222*a* for receiving a module 204*a*. The sizes of the openings 222 may vary from one spacer to another depending upon the size of the modules 204. In certain embodiments, one or more spacers without openings may additionally, or alternatively, be employed.

So as to equally space the modules 204 and provide a uniform lighting pattern, the spacers 208 may have equal lengths. However, the lengths of spacers 208 may vary from one spacer to another and uniform spacing of the modules 204 is not required. For example, it may be desirable to space the modules 204 closer together in the center of the lighting assembly 200 in order to increase illumination on the center shelves of a display case. In such an example, the spacers disposed in the center of the lighting assembly 200 may have shorter lengths than the spacers disposed at the periphery of the lighting assembly 200.

Like the modules 204, the spacers 208 are suitably white so as to reflect light away from the spacers 208, but other colors are equally amenable. Further, the spacers 208 are suitably comprised of a polymeric material, so as to reduce costs associated with the lighting assembly 200, but other materials are equally amenable. For example, the spacers 208 may be comprised of a thermally conductive material, such as aluminum.

The end caps 210, 212 are fastened to the distal ends 214, 216 of the frame 202 and serve to secure the modules 204 and/or the spacers 208 within the frame 202. Additionally, the end caps 210, 212 may provide a mounting structure to facilitate attachment of the lighting assembly 200 to a display case. However, the lighting assembly 200 may also be mounted to the display case by other means. For example, the frame 202 may be mounted directly to the mullion by way of mechanical fasteners, such as scews.

Although not shown, the lighting assembly 200 may include a cover that mounts to the frame 202 and includes a clear and/or translucent portion that allows light to pass therethrough. The translucent portion of the cover may be tinted to adjust the color of the light emitted by the lighting assembly 200.

Figure 4:
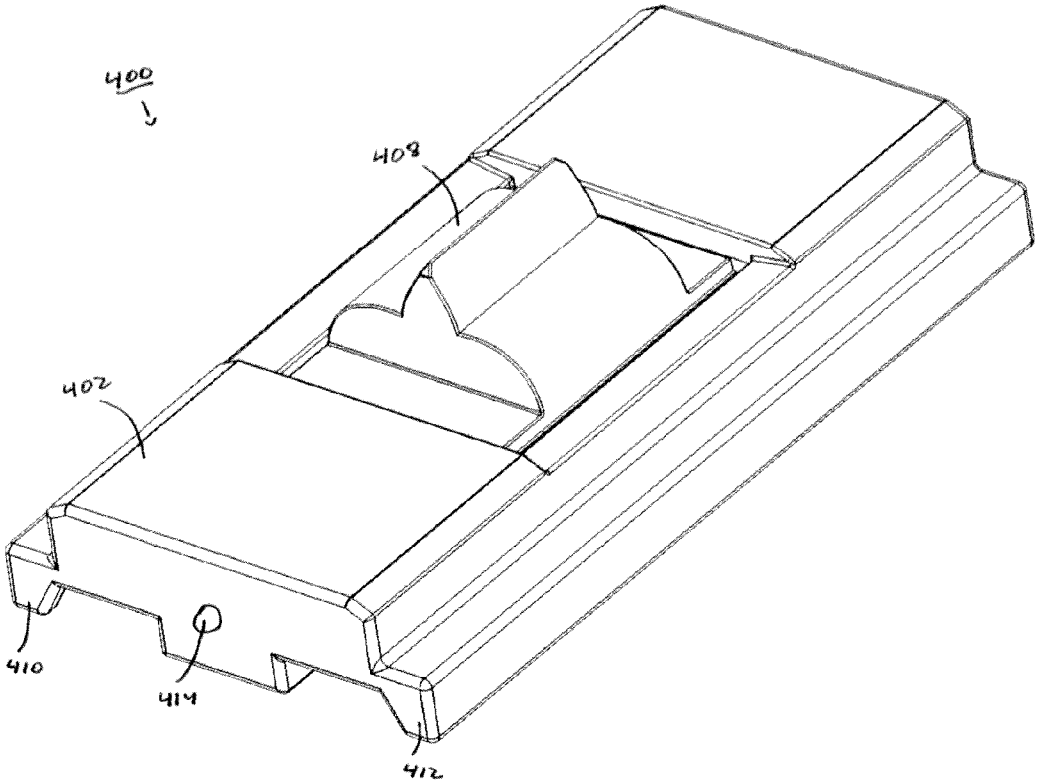
FIG. 4 is a perspective view of a light module.
Figure 5:
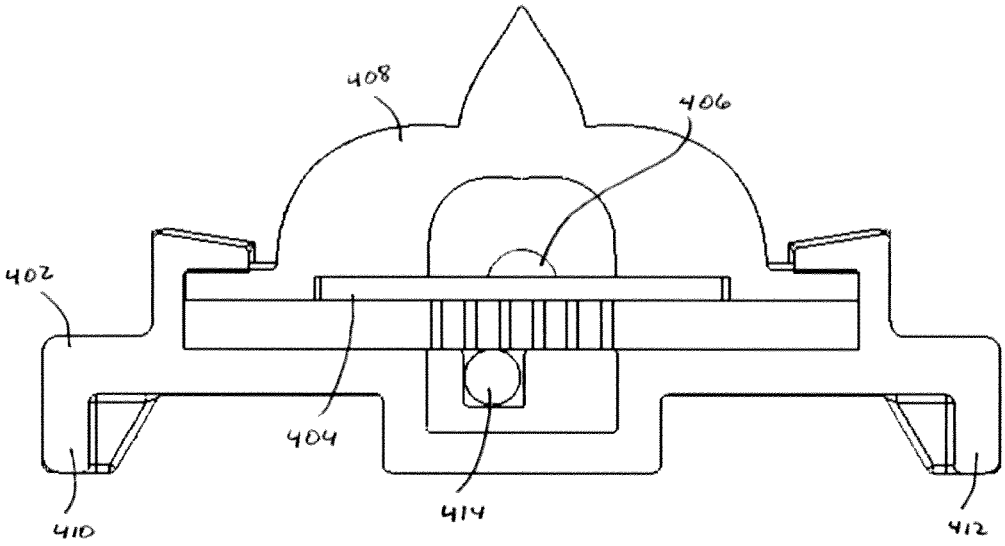
FIG. 5 is a cross sectional view of the light module of FIG. 4.

With reference to FIGS. 4 and 5, a light module 400 is illustrated. FIG. 4 is a perspective view of the light module 400, and FIG. 5 is a cross sectional view of the light module 400. As noted above, light modules provide illumination to a display case and may include one or more light sources, such as LEDs. The light module 400 may include a housing 402, a printed circuit board 404, one or more light sources 406, an optical lens 408, opposing tabs 410, 412, and a conduit 414.

The housing 402 is suitably white, so as to facilitate the reflection of light away from the housing 402. Further, the housing 402 is suitably comprised of a polymeric material, so as to reduce the cost and weight of the light module 400. However, the housing 402 need not necessarily be white and/or formed of a polymeric material. For example, the housing 402 may alternatively be formed of a thermally conductive material, such as aluminum.

The light sources 406 provide luminance to the display case employing the lighting assembly associated with the light module 400. Suitably, the light sources 406 include one or more LEDs. The light sources 406 may be selected to control Correlated Color Temperature (CCT), Color Rendering Index (CRI) and other like characteristics of light.

The printed circuit board 404 is disposed within the housing 402 and includes a lower surface opposite an upper surface, where the light sources 406 mount to the upper surface. The printed circuit board 404 may include a metal core printed circuit board ("MCPCB"), but other circuit boards are equally amenable. Further, the printed circuit board 404 may include a rectangular configuration extending along the length of the light module 400, but other configurations are equally amenable. Suitably, the printed circuit board 404 includes a plurality of traces electrically connecting the light sources 406 to the electrical power cables interconnecting the modules of the lighting assembly.

The optical lens 408 is disposed over and/or around the light sources 406. Suitably, the optical lens 408 directs light emitted from the light sources 406 such that a majority of the light is emitted to the sides of the optical lens 408. Advantageously, this allows the profile of the lighting assembly to be very thin, thereby precluding a consumer viewing the inside of the display case from seeing the optics and/or the light sources. The optic material of the optical lens 408 may be tinted to remove components of the light passing through the optical lens 408. Additionally, the optical lens 408 may include one or more of an anti-fog, an anti-glare, reflective coating and the like.

The optical lens 408 and the printed circuit board 404 are suitably secured to each other and the housing 402 by way of a plastic over mold, which defines the housing 402. However, other means of securing the optical lens 408, the printed circuit board 404 and the housing 402 are equally amenable. For example, said components may be secured together via tape, glue, mechanical fastener or the like.

The opposing tabs 410, 412 allow the light module 400 to be slidingly secured to the frame of the lighting assembly. Namely, as discussed above, the opposing tabs 410, 412 fit within grooves of the frame of the lighting assembly, thereby limiting motion of the light module 400 to motion along the length of the lighting assembly.

The conduit 414 is disposed within the housing 402 and extends along its length thereby providing a channel within which to place the electrical cables interconnecting modules. Suitably, the conduit 414 is large enough to receive one or more electrical cables interconnecting the modules of the lighting assembly. As noted above, the printed circuit board 404 is electrically coupled to the electrical cables so as to provide power to the light sources 406.

Figure 6:
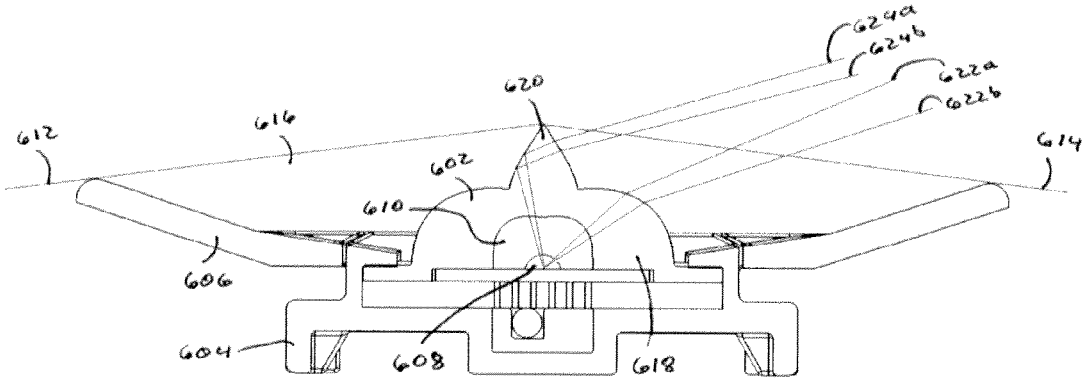
FIG. 6 is a cross sectional view of a light module.

With reference to FIG. 6, an optical lens 602 of a light module 604 is illustrated using a cross sectional view of a spacer 606 having the light module 604 disposed therein. The light module 604, in addition to including the optical lens 602, includes a light source 608 encompassed by the optical lens 602, where there is an air gap 610 between the light source 608 and the optical lens 602.

As shown, visibility lines 612, 614 extend from the tip of the optical lens 602 to the periphery of the spacer 606. The visibility lines 612, 614 define a region 616 outside the view of a consumer looking in to the display case. This region 616 is hereinafter referred to as the visibility envelope. As noted above, consumer tests have shown that it is desirable to keep the optical lens 602 and the light source 608 within the visibility envelope.

So as to ensure the optical lens 602 and the light source 608 are within the visibility envelope 616, the light source 608 and the optical lens 602 are recessed within the spacer 606. As should be appreciated, this makes it more difficult to direct the light emitted from the light source 608 to the center of the display case. The optical lens 602 addresses this difficulty by making use of a combination of total internal reflection and refraction.

The optical lens 602 may include two primary areas: a base area 618 and a triangular area 620. The base area 618 facilitates refraction of light to the sides of the light source 608 and towards the items within the display case, as shown by light rays 622. However, because the light source 608 and the optical lens 602 are recessed, the amount of light reaching the center of the display case is limited. The triangular area 620 advantageously remedies this by facilitating total internal reflection to the center of the display case, as shown by light rays 624.

Because the optical lens comes close to the paramount of the visibility envelope 616, the optical lens 602 is not as hindered by the recess. As such, the angle of light extending from the triangular area 620 can be shallower than the angle of light extending from the base area 618. This advantageously allows a larger amount of light to be directed to the center of the display case than would otherwise be possible with convention optical lenses.

In view of the foregoing, the optical lens 602 allows the display case to be more uniformly lit than would otherwise be possible. Further, the optical lens 602 does this while at the same time keeping the optical lens 602 and the light source 608 within the visibility envelope, which, as noted above, consumers test have found desirable to consumers.

Figure 7:
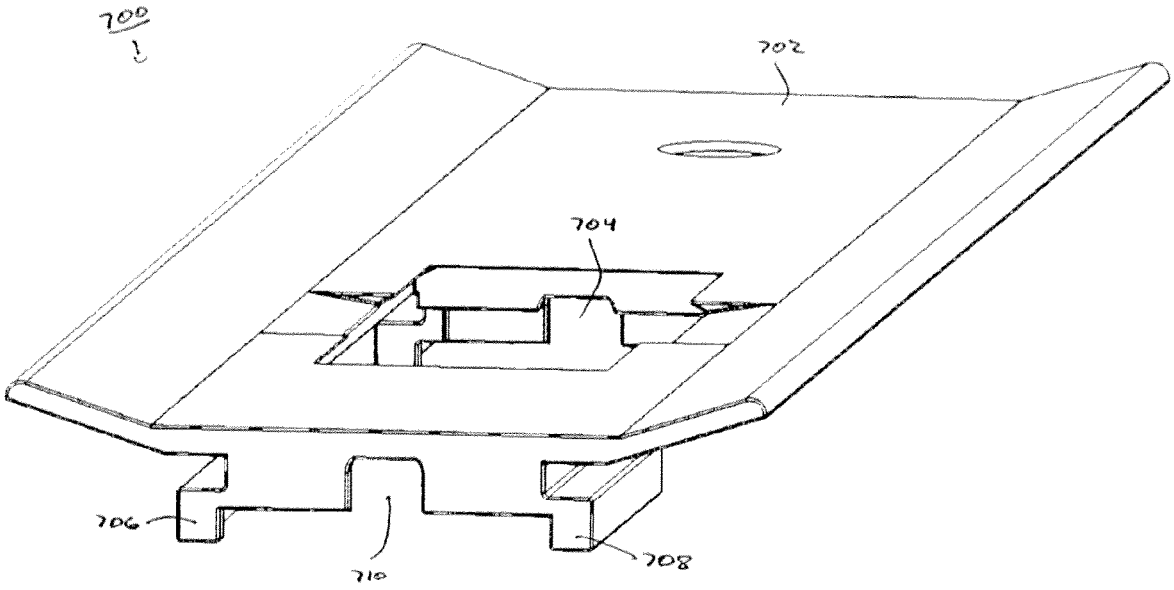
FIG. 7 is a perspective view of a spacer module.

With reference to FIG. 7, a perspective view of a spacer 700 is illustrated. As noted above, spacer modules serve to orient modules. The spacer 700 may include a housing 702, an opening 704, opposing tabs 706, 708, and a groove 710.

The housing 702 is suitably white, so as to facilitate the reflection of light away from the housing 702. Further, the housing 702 is suitably comprised of a polymeric material, so as to reduce the cost and weight of the spacer 700.

The opening 704 is suitably disposed within the housing 702 and serves to receive and secure a light module. The size of the opening 704 may vary depending upon the size of the light module.

The opposing tabs 706, 708 allow the spacer 700 to be slidingly secured to the frame of the lighting assembly. Namely, as discussed above, the opposing tabs 706, 708 fit within grooves of the frame of the lighting assembly, thereby limiting motion of the spacer 700 to motion along the length of the lighting assembly.

The groove 710 extends along the length of the housing 702 thereby providing a channel within which to place the electrical cables interconnecting modules. Suitably, the groove 710 is large enough to receive one or more electrical cables interconnecting the modules of the lighting assembly.

With reference to FIG. 8, an exploded view of a lighting assembly 800 is illustrated. The lighting assembly 800 is similar to the lighting assembly 200 described with reference to FIG. 2. However, this lighting assembly 800 is configured to be mounted vertically in a corner of a display case such that light is typically directed to only one side of the assembly 800. The lighting assembly 800 may include an elongated frame 802, one or more modules 804, one or more electrical cables 806, one or more spacers 808, end caps 810, 812, and a cover (not shown).

The frame 802 is suitably L-shaped. Further, the frame 802 substantially defines the lighting assembly 800 and provides a structure on which to secure the modules 804 and/or the spacers 808. The modules 804 and/or the spacers 808 are hereafter referred to as the modular inserts. Suitably, the modular inserts are slidingly secured to the frame 802 via a channel defined by opposing grooves running along the length of the frame 802. In such embodiments, each of the modular inserts includes opposing tabs that interlock with the opposing grooves, thereby limiting the range of motion of the modular inserts to motion along the length of the frame 802. The end caps 810, 812 then prevent the modular inserts from sliding out of the frame 802.

Figure 9:
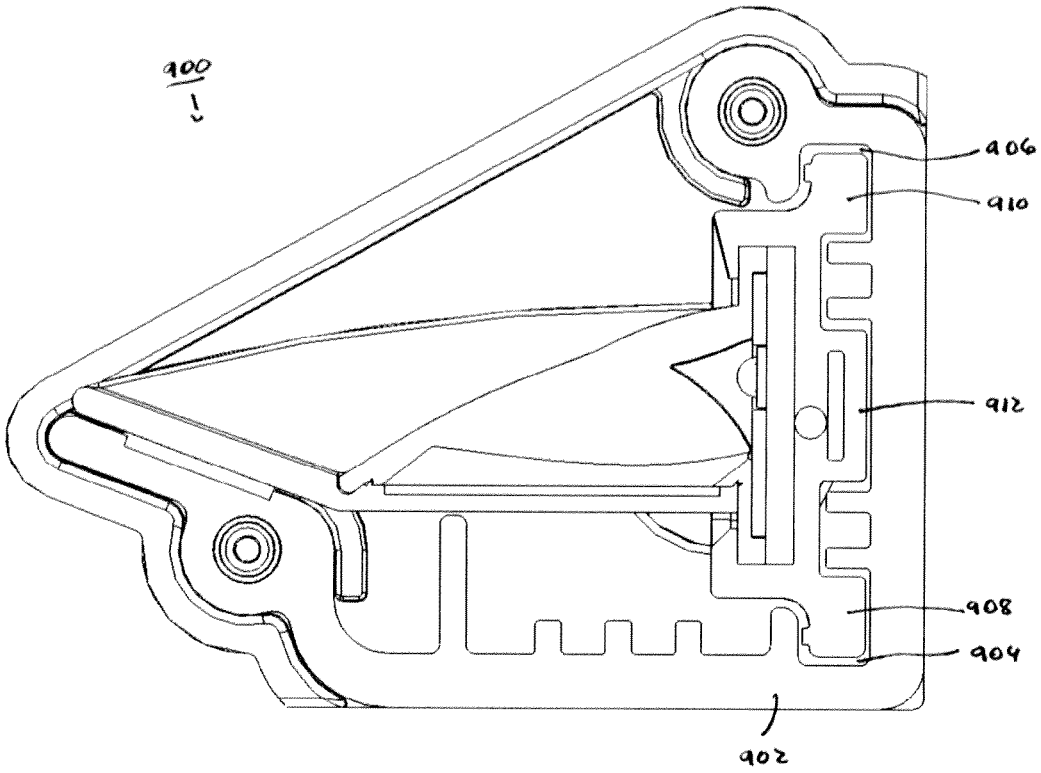
FIG. 9 is a cross sectional view of a lighting assembly.

Referring to FIG. 9, a cross sectional view of a lighting assembly 900 illustrates the interlocking system of grooves and tabs. Therein, a frame 902 of the lighting assembly 900 includes opposing grooves 904, 906 extending along the length of the frame 902. Opposing tabs 908, 910 on a modular insert 912 then interlock with the grooves 904, 906, so as to limit motion of the modular insert 912 to motion along the length of the frame 902.

Referring back to FIG. 8, the frame 802 is preferably comprised of a polymeric material, so as to reduce costs associated with the lighting assembly 800. However, the frame 802 need not necessarily be polymeric, whereby the frame 802 may, for example, be comprised of a thermally conductive material, such as aluminum, so as to act as a heat sink and facilitate the transfer heat away from the lighting assembly 800.

The modules 804 are suitably comprised of a polymeric material, so as to reduce costs associated with the lighting assembly 800, but other materials equally amenable. For example, as with the frame 802, the modules 804 may be comprised of a thermally conductive material, such as aluminum, so as to act as a heat sink and facilitate the transfer heat away from the lighting assembly 800.

So that power may be transferred from one end 814, 816 of the lighting assembly 800 to the other end 814, 816 of the lighting assembly 800, the modules 804 may be interconnected with one or more electrical cables 806. The electrical cables 806 may run through grooves on the modular inserts. Alternatively, the electrical cables 806 may be disposed within the modular inserts. In such embodiments, each modular insert preferably has an electrical cable running therethrough between a pair of connectors, where the connectors of adjacent modular inserts are provisioned to mechanically couple to one another and electrically connect the individual electrical cables.

The modules 804 may include at least one of one or more light modules 818, one or more power modules 820, and the like. The light modules 818 may provide illumination to a display case and may include one or more light sources. Suitably, the light sources include one or more LEDs. The power modules 820 may provide illumination to a display case and/or provide power to the light modules 818. Suitably, the power modules 820 receive power from an external power source and are disposed on the distal ends 814, 816 of the frame 802, so as to easily receive power from the external power source. The power modules 820 may include one or more of a light module, a power regulating circuit, a power conditioning circuit, and the like.

The power regulating circuit regulates the flow of current through the modules 804 so as to allow the lighting assembly 800 to dynamically adapt to an increased load; for example, an additional light module. Preferably, this is accomplished with a simple DC-DC converter, but other means of accomplishing this are equally amenable.

The power conditioning circuit may convert alternating current voltage to a direct current voltage. For example, the power conditioning circuit may convert 120 or 240 volt alternating current voltage to a direct current voltage. The power conditioning circuit may additionally, or alternatively, correct for polarity of the incoming power so that the power supply wires that connect to the power module 820 can be connected without having to worry about which wire connects to which element of the power conditioning circuit.

The spacers 808 serve to orient the modules 804 within the frame 802. Suitably, the spacers 808 alternate with the modules 804 along the length of the frame 802 and have equal lengths so as to equally space the modules 804 and provide a uniform lighting pattern. However, the lengths of spacers 808 may vary from one spacer to another and uniform spacing of the modules 804 is not required. For example, it may be desirable to space the modules 804 closer together in the center of the lighting assembly 800 in order to increase illumination on the center shelves of a display case. In such an example, the spacers disposed in the center of the lighting assembly 800 may have shorter lengths than the spacers disposed at the periphery of the lighting assembly 800.

The spacers 808 are suitably white so as to reflect light away from the spacers 808, but other colors are equally amenable. Further, the spacers 808 are suitably comprised of a polymeric material, so as to reduce costs associated with the lighting assembly 800, but other materials equally amenable. For example, the spacers 808 may be comprised of a thermally conductive material, such as aluminum. In certain embodiments, when the end of a spacer is adjacent to a module, the spacers 808 are shaped as module reflectors to help reflect light away from the lighting assembly. Module reflectors are discussed below.

The end caps 810, 812 are fastened to the distal ends 814, 816 of the frame 802 and serve to secure the modular inserts (i.e., the one or more of the modules 804, the spacers 808 and the reflectors 810) within the frame 802. Additionally, the end caps 810, 812 provide a mounting structure to facilitate attachment of the lighting assembly 800 to a display case. It should be appreciated, however, that the lighting assembly 800 can be mounted to the display case by other means. For example, the frame 802 may be mounted directly to the mullion by way of mechanical means.

Although not shown, the lighting assembly 800 may include a cover that mounts to the frame 802 and includes a clear and/or translucent portion that allows light to pass therethrough. The translucent portion of the cover may be tinted to adjust the color of the light emitted by the lighting assembly 800.

Figure 10:
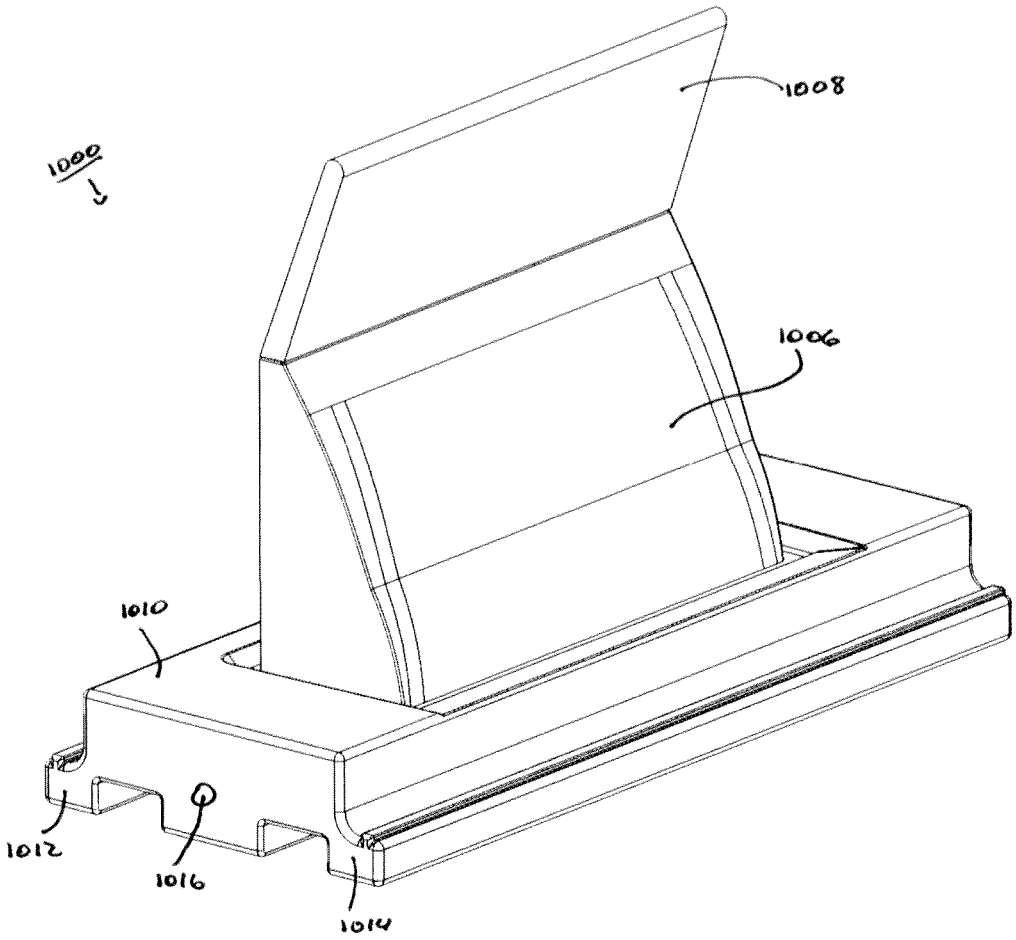
FIG. 10 is a perspective view of a light module.
Figure 11:
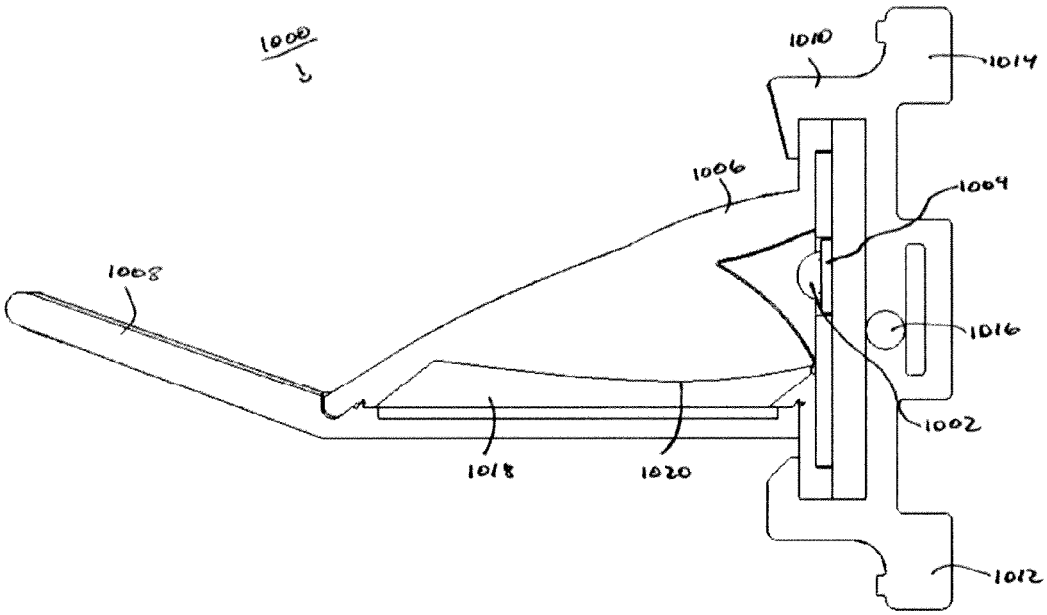
FIG. 11 is a cross sectional view of the light module of FIG. 10.

With reference to FIGS. 10 and 11, a light module 1000 is illustrated. FIG. 10 is a perspective view of the light module 1000, and FIG. 11 is a cross sectional view of the light module 1000. As noted above, light modules provide illumination to a display case and may include one or more light sources, such as LEDs. The light module 1000 may include one or more light sources 1002, a printed circuit board 1004, an optical lens 1006, a reflector 1008, a housing 1010, opposing tabs 1012, 1014, and a conduit 1016.

The light sources 1002 provide luminance to the display case employing the lighting assembly associated with the light module 1000. Suitably, the light sources include one or more LEDs, The light sources 1002 may be selected to control Correlated Color Temperature (CCT), Color Rendering Index (CRI) and other like characteristics of light.

The printed circuit board 1004 is disposed within the housing 1010 and includes a lower surface opposite an upper surface, where the light sources 1002 mount to the upper surface. The printed circuit board 1004 may include a metal core printed circuit board ("MCPCB"), but other circuit boards are equally amenable. Further, the printed circuit board 1004 may include a rectangular configuration extending along the length of the light module, but other configurations are equally amenable. Suitably, the printed circuit board 1004 includes a plurality of traces electrically connecting to the light sources 1002 to the electrical power cables interconnecting the modules of the lighting assembly.

The optical lens 1006 is disposed over and/or around the light sources 1002. Suitably, the optical lens 1006 directs light emitted from the light sources 1002 such that a majority of the light is emitted to the sides of the optical lens 1006. Advantageously, this allows the profile of the lighting assembly to be very thin, thereby precluding a consumer viewing the inside of the display case from seeing the optics and/or the light source. The optic material of the optical lens 1006 may be tinted to remove components of the light passing through the optical lens 1006. Additionally, the optical lens 1006 may include one or more of an anti-fog, an anti-glare, reflective coating and the like.

The reflector 1008 a reflects light generated by the light sources 1002 to the center of the display case. Suitably, the reflector 1008 is bonded to the optical lens 1006 by means of sonic weld, vibration weld, adhesive, or the like to define an air gap 1018. As will be seen, the optical lens makes use of total internal reflection along a boundary 1020 abutting this air gap. This bonding protects the boundary 1020 from condensation buildup of any material (e.g., food elements from spills) that would frustrate total internal reflection. This is important because the boundary 1020 is not exposed and cannot be cleaned.

So as to facilitate the reflection of light away from the reflector 1008, the reflector 1008 is suitably white. Further, the reflector 1008 is suitably comprised of a polymeric material, so as to reduce the cost and weight of the light module 1000. However, the reflector 1008 need not necessarily be white and/or formed of a polymeric material. For example, the reflector 1008 may alternatively be formed of a thermally conductive material, such as aluminum.

The housing 1010 holds the optical lens 1006, the printed circuit board 1004, and the reflector 1008 together. To accomplish this, the housing 1010 suitably includes a plastic over mold. However, other means of securing the optical lens 1006, the printed circuit board 1004, and the reflector 1008 to the housing 1010 are equally amenable. For example, the optical lens 1006, the printed circuit board 1004, and the reflector 1008 may be secured to the housing via tape, glue, mechanical fastener or the like. So as to reduce its visibility to an onlooker of the display case, the housing 1010 is suitably black. Further, as with the reflector 1008, the housing 1010 is suitably comprised of a polymeric material, so as to reduce the cost and weight of the light module 1000.

The opposing tabs 1012, 1014 allow the light module 1000 to be slidingly secured to the frame of a lighting assembly. Namely, as discussed above, the opposing tabs 1012, 1014 fit within grooves of the frame of the lighting assembly, thereby limiting motion of the light module 1000 to motion along the length of the lighting assembly.

The conduit 1016 is disposed within the housing 1010 and extends along its length thereby providing a channel within which to place the electrical cables interconnecting modules. Suitably, the conduit 1016 is large enough to receive one or more electrical cables interconnecting the modules of the lighting assembly. As noted above, the printed circuit board 1004 is electrically coupled to the electrical cables so as to provide power to the light source 1002.

Figure 12:
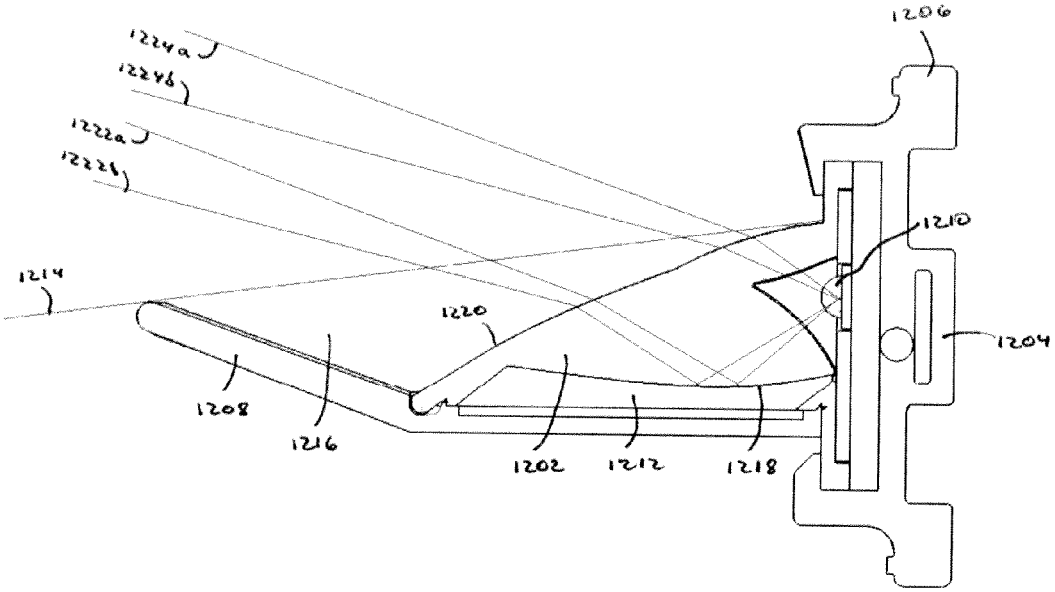
FIG. 12 is a cross sectional view of a light module.

With reference to FIG. 12, an optical lens 1202 of a light module 1204 is illustrated using a cross sectional view of the light module 1204. The light module 1204, in addition to including the optical lens 1202, includes a housing 1206, a reflector 1208 and a light source 1210 encompassed by the optical lens 1202, where there is an air gap 1212 between the light source 1210 and the optical lens 1202.

As shown, a visibility line 1214 extends from the optical lens 1202 to the periphery of the light module 1204. The visibility line 1214 defines a region 1216 outside the view of a consumer looking in to the display case. This region 1216 is hereinafter referred to as the visibility envelope. Consumer tests have shown that it is desirable to keep the optical lens 1202 and the light source 1210 within the visibility envelope 1216. In certain embodiments, the housing 1206, which generally falls outside the visibility envelopment 1216, is black so as to make it less visible, whereas the reflector 120, which falls within the visibility envelope 1216, is suitably white.

So as to ensure the optical lens 1202 and the light source 1210 are within the visibility envelope 1216, the light source 1210 and the optical lens 1202 are recessed within the light module 1204. As should be appreciated, the reflector 1208 of the light module 1204 helps defines the recess. While recessing the light source 1210 and the optical lens 1202 helps keep the light source 1210 and the optical lens 1202 in the visibility envelope 1216, it also makes it more difficult to direct the light emitted from the light source 1210 to the center of the display case.

The optical lens 1202 addresses this difficulty by making use of a combination of total internal reflection and refraction. Most of the light given off by the light source 1210 is originally directed to a first boundary 1218. This light reflects off the first boundary 1218 and then refracts towards the center of the display case via a second boundary 1220, as shown by light rays 1222. The remaining light given off by the light source 1210 is originally directed to the second boundary 1220 and refracts to the display case, as shown by light rays 1224. This light is spread from close to the light module 1204 to close to the center of the display case depending upon where it crosses along the length of the second boundary. For example, the light rays going left (as oriented by FIG. 12) are directed toward the center of the display case while the light rays going up are directed closer to the light module 1204.

In view of the foregoing, the optical lens 1202 allows the display case to be more uniformly lit than would otherwise be possible. Further, the optical lens 1202 does this while at the same time keeping the optical lens 1202 and the light source 1210 within the visibility envelope 1216, which, as noted above, consumers test have found desirable to consumers.

The lighting assemblies have been described with reference to the disclosed embodiments. Furthermore, components that are described as a part of one embodiment can be used with other embodiment. The invention is not limited to only the embodiments described above. Instead, the invention is defined by the appended claims and the equivalents thereof.

The invention claimed is:

1. A lighting assembly for illuminating a display case, said assembly comprising:

an elongated frame; and, a plurality of modular inserts removably connected to the elongated frame, wherein the plurality of modular inserts include a plurality of light modules and at least one spacer, wherein each of the plurality of light modules is removably coupled to adjacent light modules electrically;

wherein said light modules comprise a printed circuit board hosting at least one light emitting diode (LED), a lens optically coupled to said at least one LED, said printed circuit board and said lens being retained by a housing, said housing including opposing tabs configured to be received slidably in the frame; and wherein the spacer comprises a housing defining an opening, said opening configured to receive said light module, said spacer further including opposing tabs configured to be received slidably in the frame.

2. The assembly of claim 1, wherein the each of the plurality of light modules is disposed within one of the at least one spacer.

3. The assembly of claim 2, wherein the plurality of modular inserts includes a plurality of spacers, wherein the plurality of light modules and the plurality of spacers alternate along the length of the lighting assembly.

4. The assembly of claim 1, wherein the each of the plurality of light modules is in electrical communication with each other light module.

5. The assembly of claim 1, wherein each of the plurality of light modules receives power from an external power supply electrically connected to one of the plurality of modular inserts disposed at a distal end of the lighting assembly.

6. The assembly of claim 5, wherein the plurality of modular inserts includes a power module disposed on a distal end of the lighting assembly.

7. The assembly of claim 1, wherein the lens directs a majority of light generated by the at least one light source perpendicular to the normal of a base upon which the at least one light source rests.

8. A lighting assembly for illuminating a display case, said assembly comprising:

an elongated frame; and, a plurality of modular inserts removably connected to the elongated frame, wherein the plurality of modular inserts include a plurality of light modules and at least one spacer, wherein each of the plurality of light modules is removably coupled to adjacent light modules electrically;

wherein said light modules comprise a printed circuit board hosting at least one light emitting diode (LED), a lens optically coupled to said at least one LED, said printed circuit board and said lens being retained by a housing, said housing including opposing tabs configured to be received slidably in the frame; and wherein the spacer comprises a housing defining an opening, said opening configured to receive said light module, said spacer further including opposing tabs configured to be received slidably in the frame and opposed raised peripheral edges, and wherein a line connecting said edges in conjunction with the housing defines a region encompassing said LED.

9. A lighting assembly for illuminating a display case, said assembly comprising:

an elongated frame; and, a plurality of modular inserts removably connected to the elongated frame, wherein the plurality of modular inserts include a plurality of light modules and at least one spacer, wherein each of the plurality of light modules is removably coupled to adjacent light modules electrically;

wherein said light modules comprise a printed circuit board hosting at least one light emitting diode (LED), a lens optically coupled to said at least one LED, said printed circuit board and said lens being retained by a housing, said housing including opposing tabs configured to be received slidably in the frame and a conduit configured to receive an electrical cable;

wherein the spacer comprises a housing defining an opening, said opening configured to receive said light module, said spacer further including opposing tabs configured to be received slidably in the frame and a groove configured to receive said electrical cable.

* * * * *